US006384728B1

(12) United States Patent
Kanor et al.

(10) Patent No.: US 6,384,728 B1
(45) Date of Patent: May 7, 2002

(54) PERSONAL CARE MONITORING SYSTEM

(75) Inventors: Steven E. Kanor, Hastings-on-Hudson, NY (US); Richard C. Hirsch, Glen Rock, NJ (US)

(73) Assignee: Toys For Special Children, Inc., Hastings-On-Hudson, NY (US)

( * ) Notice: Subject to any disclaimer, the term of this patent is extended or adjusted under 35 U.S.C. 154(b) by 0 days.

(21) Appl. No.: 09/527,321

(22) Filed: Mar. 17, 2000

(51) Int. Cl.[7] ..... G08B 23/00

(52) U.S. Cl. ..... 340/573.1; 340/309.15; 340/604; 340/605; 368/10

(58) Field of Search ..... 340/573.1, 309.15, 340/604, 605; 604/361; 368/10

(56) References Cited

U.S. PATENT DOCUMENTS

| | | | | | |
|---|---|---|---|---|---|
| 3,460,123 | A | | 8/1969 | Bass | 340/235 |
| 3,508,235 | A | | 4/1970 | Baisden | 340/235 |
| 3,696,357 | A | | 10/1972 | Kilgore | 340/235 |
| 3,824,560 | A | | 7/1974 | Vitolo et al. | 340/172.5 |
| 4,069,817 | A | | 1/1978 | Fenole et al. | 128/138 |
| 4,106,001 | A | | 8/1978 | Mahoney | 340/604 |
| 4,179,692 | A | | 12/1979 | Vance | 340/573 |
| 4,484,573 | A | | 11/1984 | Yoo | 128/138 |
| 4,539,559 | A | | 9/1985 | Kelly et al. | 340/573 |
| 4,700,180 | A | | 10/1987 | Vance | 340/573 |
| 4,754,264 | A | | 6/1988 | Okada et al. | 340/573 |
| 4,796,014 | A | | 1/1989 | Chia | 340/573 |
| 4,800,370 | A | | 1/1989 | Vetecnik | 340/573 |
| 4,977,909 | A | | 12/1990 | Di Scipio | 128/885 |
| 5,036,859 | A | | 8/1991 | Brown | 128/734 |
| 5,121,630 | A | | 6/1992 | Calvin | 73/73 |
| 5,137,033 | A | | 8/1992 | Norton | 128/886 |
| 5,144,284 | A | | 9/1992 | Hammett | 340/573 |
| 5,258,745 | A | * | 11/1993 | Colling | 340/573 |
| 5,264,830 | A | | 11/1993 | Kline et al. | 340/604 |
| 5,266,928 | A | | 11/1993 | Johnson | 340/604 |
| 5,341,127 | A | * | 8/1994 | Smith | 340/604 |
| 5,353,012 | A | | 10/1994 | Barham et al. | 340/573 |
| 5,392,032 | A | | 2/1995 | Kline et al. | 340/604 |
| 5,416,469 | A | * | 5/1995 | Colling | 340/573 |
| 5,459,452 | A | | 10/1995 | DePonte | 340/604 |
| 5,469,145 | A | | 11/1995 | Johnson | 340/604 |
| 5,557,263 | A | * | 9/1996 | Fisher et al. | 340/605 |
| 5,568,128 | A | * | 10/1996 | Nair | 340/604 |
| 5,583,832 | A | * | 12/1996 | DePanty | 368/10 |
| 5,590,038 | A | | 12/1996 | Pitroda | 395/241 |
| 5,622,429 | A | | 4/1997 | Heinze | 395/200.08 |
| 5,709,222 | A | | 1/1998 | Davallou | 128/885 |

(List continued on next page.)

*Primary Examiner*—Daniel J. Wu
*Assistant Examiner*—Phung Nguyen
(74) *Attorney, Agent, or Firm*—Pennie & Edmonds LLP

(57) ABSTRACT

A personal care monitoring system having at least one condition detecting sensor and a corresponding condition indicator. The condition detecting sensor may indicate detection of wetness, such as caused by enuresis. Alternatively, or additionally, the condition detecting sensor may indicate that the physical position of the wearer of the device has not been adjusted for over a predetermined amount of time after which the likelihood of the development of bedsores increases. The indicator may be any desired type of indicator, preferably alerting one of the senses that the monitored condition has been detected. For instance, the indicator may be a light, an audible alarm, or a vibrating device. A processing means preferably is provided to control operation of the various components of the monitoring system. Moreover, the processing means may be programmed to store information pertaining to the operation of the components of the monitoring system. For example, the time at which a condition has been detected as well as the time at which a care giver has attended to the condition may be recorded. Such information may be retrieved to determine the frequency of care given to the wearer of the monitoring system as well as the amount of time elapsed between occurrence of the monitored condition and attendance to such condition by the care giver.

24 Claims, 12 Drawing Sheets

U.S. PATENT DOCUMENTS 5,751,214 A * 5/1998 Cowley et al. ..... 340/573
5,754,096 A * 5/1998 Muto et al. ..... 340/407.1
5,867,105 A * 2/1999 Hajel ..... 340/407.1
5,868,723 A * 2/1999 Al-Sabah ..... 604/361
5,903,222 A * 5/1999 Kawarizadeh et al. ..... 340/604
5,929,747 A * 7/1999 Rosenblatt et al. .... 340/309.15
5,977,867 A * 11/1999 Blouin ..... 340/407.2
6,014,346 A * 1/2000 Malone ..... 368/10
6,255,937 B1 * 7/2000 Hamaguchi ..... 340/384.7
6,139,495 A * 10/2000 De La Huerga ..... 600/300

* cited by examiner

PERSONAL CARE MONITORING SYSTEM

FIELD OF THE INVENTION

The present invention relates to a device or system for monitoring a personal condition and indicating such condition to the wearer of the device and/or to a care giver. More particularly, the present invention relates to a monitoring system utilizing a microprocessor to monitor a personal condition and to indicate occurrence of such condition.

BACKGROUND OF THE INVENTION

A variety of devices for monitoring undesirable personal hygienic conditions are known in the art. For example, various devices for monitoring whether a diaper is wet are known in the art. Diaper monitoring devices typically include a wetness detecting sensor coupled to the diaper to detect wetness and an indicator, such as an alarm or a light, that may be used to indicate to the care giver that the diaper is soiled and must be changed.

With the growing recognition of adult incontinence, wetness monitoring devices have been adapted for adult use. If the device is to be used by a cognizant adult, a vibrating mechanism may be provided, as disclosed in U.S. Pat. No. 4,977,906 to Di Scipio, instead of an indicator noticeable by third parties. The use of a vibrating mechanism provides privacy by alerting only the wearer, thereby preventing embarrassment which may occur if an auditory alarm were sounded.

With the increase in use and popularity of wetness detecting devices, additional capabilities or functions have been added to such devices, such as sensors for determining whether the patient has left his or her bed or is in distress. For example, U.S. Pat. No. 5,459,452 to DePonte discloses a device for monitoring wetness and also heat (to determine whether the patient has left the bed). U.S. Pat. No. 5,137,033 to Norton discloses a patient monitoring device which notifies not only of wetness but also of a distress condition such as whether the chair in which the patient is seated is tilted.

The increased availability and reduced cost of microcontrollers has permitted various improvements to simple personal monitoring devices. For example, the use of a microcontroller permits additional monitoring capabilities to assist in regulating diaper-changing frequency or to assist in toilet training. As disclosed in U.S. Pat. No. 5,568,128 to Nair, a self-learning wetness detector with a timer land recording device may be provided if a microcontroller is used. A microcontroller records wetness incidents and predicts when wetting will next occur, i.e., the microcontroller learns the wetting pattern of the child. The timer device thus records wetting events, calculates when the next wetting event will occur, and, in anticipation of another wetting event, indicates when the child should be taken to the toilet. Adult incontinence monitoring devices may;be provided with timing devices as well. For example, the above-mentioned patent to Di Scipio discloses the use of a timer for biofeedback purposes and/or to predict the next occurrence of an enuresis incident.

Advances in technology have also resulted in advances in the indicator devices used with personal monitoring devices. For example, remote signaling features may be provided to assist a care giver in monitoring a bedridden individual using a personal monitoring device. As disclosed in U.S. Pat. No. 4,800,370 to Vetecnik, a wetness monitoring device with a timer may be used to emit radio signals to a remote station so that the care giver may monitor the patient without being near the wetness detecting device.

Despite the variety of features provided with personal monitoring devices, such devices typically are designed as single-function devices which monitor only a single condition. However, an individual with one condition, such as enuresis, may have other conditions which warrant monitoring as well. For example, the physical position of a bedridden individual must have his position adjusted regularly to prevent development of decubitus ulcers or bed sores. However, a care giver may attend to an enuresis episode without also adjusting the patient's physical position if not properly reminded to do so. Nonetheless, wetness indicators do not typically signal that any other type of care, other than attendance to the wet condition, is required.

Yet another drawback of known personal monitoring devices is that the focus of such devices has been to monitor the patient, not the level of care given to the patient. In particular, there is no manner of monitoring the frequency or alacrity with which a care giver responds to the warning signal emitted by the detecting device and tends to the wearer. Thus, the use of a personal monitoring device gives no assurance that the device will actually be used as intended.

SUMMARY OF THE INVENTION

In accordance with the present invention, a monitoring system is provided to detect the occurrence of an undesired condition which may cause discomfort to an individual. Such conditions include, without limitation, wetness (such as that caused by enuresis), and lack of physical movement (which may cause bedsores). The monitoring system may be formed to indicate the monitored condition for detection only by the wearer or for ready detection by another individual, such as a care giver.

A monitoring system formed in accordance with the present invention may be configured to detect more than one condition, such as wetness as well as lack of physical movement or repositioning of the individual. Thus, a care giver need use only a single monitoring system to monitor more than one condition of the patient, e.g., whether the patient has soiled undergarments and/or bedsheets and also whether the patient needs to be turned or to have his or her position otherwise adjusted to prevent the development of bedsores. By using a single monitoring system to monitor more than one condition, the present invention facilitates the care giver's job. Because the care giver only needs to refer to one monitoring system, there is less risk that the care giver will forget to check a separate monitoring device for a separate condition to be monitored. Moreover, the consolidation of separate monitoring devices into a single monitoring system reduces costs as well as clutter.

Preferably, the monitoring system of the present invention includes a processing means such as a microcontroller, microprocessor, or other device capable of performing various functions such as monitoring the occurrence of a particular condition and the frequency with which the condition has been alleviated. The use of a compact processing means such as a microprocessor reduces the size of the monitoring system and permits features to be provided on the device which have not been provided on existing devices. For example, the processing means may be designed to record that a monitored event has occurred and also to record the time elapsed between emission of the indicator signal (indicating that the monitored condition or event has been detected) and attendance to the patient by the care giver. Such a feature may be used to monitor the frequency and promptness with which the care giver is attending to the patient. Moreover, the processing means can be configured to keep an ongoing record for future reference. A reader device may be provided to read the information from memory associated with the processing means and, if desired, to upload the information to another processing means or larger processing system.

The monitoring system of the present invention may be made to transmit signals, such as via radio transmitters, to a remote location, such as a monitoring station in the care facility, so that the signals can be monitored centrally and/or recorded at such location. Thus, the care giver need not be near the patient when a signal indicating occurrence of the monitored condition is generated.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
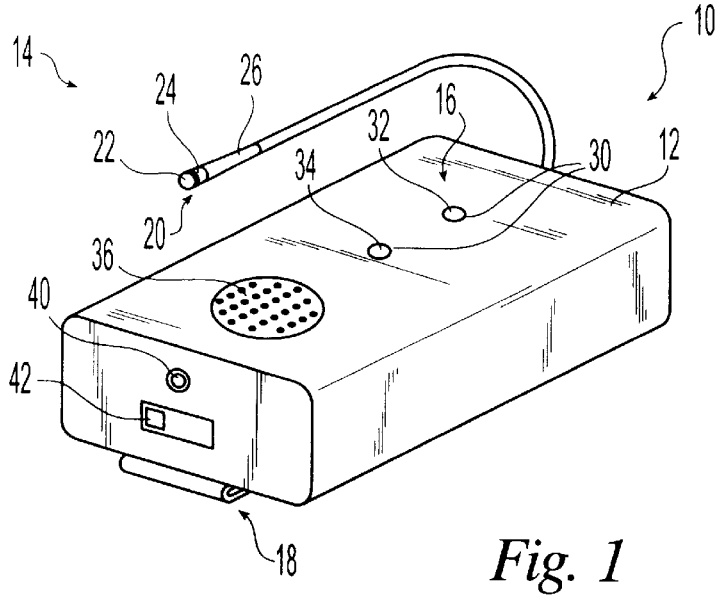
FIG. 1 shows a monitoring system providing monitoring and indicating functions in accordance with the principles of the present invention.

In accordance with the present invention, a monitoring system is provided with appropriate devices for monitoring at least one condition and indicating occurrence or detection of the condition so that the condition may be attended to or corrected. Additional functional devices may be provided to perform additional desired functions, such as recording events (e.g., condition detection or attendance to the condition), communicating the recorded event or events, programming the monitoring system, etc. Typically, the monitoring system includes a primary housing which is worn by the user of the device (alternately referenced as the monitored individual). Preferably, the primary housing houses a condition detecting sensor and preferably also a condition indicator. It will be appreciated that the various additional functional devices associated with the monitoring system may be provided in the primary housing or may be housed in a separate housing.

In one embodiment, the monitoring system of the present invention is configured to detect wetness or another undesirable physical condition. For example, the monitoring system may be configured to monitor enuresis, bed-wetting, or other unintentional body function which results in an undesired condition such as soiling of garments or other materials contacting or in close proximity with an individual. Alternatively, the monitoring system may monitor the amount of time which has elapsed since the position of an individual has been changed or adjusted in order to notify a care giver to reposition or turn the patient to prevent the development of decubitus ulcers or bedsores. The monitoring system of the present invention thus preferably is provided with a condition detecting sensor configured to monitor and detect a particular condition as well as an indicator configured to indicate that the sensor has detected the condition being monitored. Preferably, the sensor and indicator are provided in a primary monitoring system housing.

The sensor of the monitoring system of the present invention is selected to permit ready detection of the condition being monitored and therefore may be provided in any of a variety of configurations. For example, the sensor may be a wetness detecting sensor configured to detect wetness caused by soiled undergarments, bedsheets, or other material contacting or in close proximity to an individual, as described in further detail below.

The indicator of the monitoring system of the present invention may be provided in any desired configuration preferably permitting an individual (either the wearer of the monitoring system or another party, such as a care giver) to readily determine that the monitored condition has been detected. For example, the indicator may be an audible alarm, one or more lights, or any other device capable of emitting a detectable sensory signal, as described in further detail below. If the user does not want others to be aware of the use of such monitoring system, the indicator may be in the form of a vibrating device or any other indicator which is not readily detected by anyone other than the user of the monitoring system.

A reset button may be provided so that after attendance to the detected condition, the indicator may be reset to an initial state in which no condition is indicated as having been detected. If the monitoring system is to be used by care givers to monitor their patients or wards, then the indicator may be positioned at a remote location, such as the care giver's workstation, or may be configured to emit a signal, such as a radio signal, to a receiver at a remote location such as the care giver's workstation. Thus, the care giver may be apprized of detection of the monitored condition without necessarily being in close proximity to the monitoring system.

In situations where a monitoring system in accordance with the present invention is used for monitoring a bedridden individual in the care of a care giver, the monitoring system may include additional sensors for detecting other conditions to be monitored. For example, the monitoring system of the present invention may additionally be provided with a timer for monitoring the frequency with which the position of the bedridden individual has been adjusted (e.g., the frequency with which the individual has been turned over in bed or shifted from a particular seated position). Such a timer, referenced hereafter as a turn timer for simplicity, is important for assuring that the position of the individual is modified with sufficient frequency so that the individual does not develop bedsores or decubitus ulcers. Such turn timer may be integrated into the monitoring system so that the monitoring system monitors the occurrence of a first condition, such as garment soiling, in addition to monitoring a second condition to be monitored and addressed, such as position modification. The conditions being monitored by the monitoring system of the present invention need not necessarily be related to each other.

A processing means, such as a microcontroller, a microprocessor, or other processor device, preferably is provided to control at least the monitoring and indicating functions of the monitoring system of the present invention. Preferably, the processing means is a compact, inexpensive processing means as known in the art to provide reduced costs, energy consumption, and size, as well as other known benefits associated with processing means. The processing means preferably has the capacity to control more than one sensor and associated indicator, thereby reducing the overall size and increasing the efficiency of the monitoring system. Any processing means may be used which may achieve the desired functions described herein.

Further in accordance with the present invention, a monitoring system as described above may include a recording device which keeps a record of the frequency of detected conditions or events, the frequency with which an undesired condition has been alleviated or another desired step or action has been performed, or other pertinent information such as relating to the condition being monitored or the adequacy of care being given in attending to the condition. The recording device may be incorporated integrally into the primary monitoring system housing or may be provided in a separate housing. The indicator communicates via hard-wired or wireless (e.g., via radio frequency or infrared signals) transmission to the recording device.

Recording capabilities are particularly desirable in monitoring systems used with individuals under the care of a care giver. The recording of the frequency with which events or conditions occur may be used by the care giver to tailor a care giving regimen for a specific individual. For example, such a record may be used to determine the frequency with which certain undesired conditions occur so that the care giver may attend to the individual in anticipation of the next undesired event, thus reducing the amount of time the individual must endure the undesired condition. Such a record may also be used by the care giver to monitor the frequency with which the position of a particular individual must be adjusted in order to prevent the formation of bedsores.

A recording function is also useful for monitoring the care being provided by a care giver. For example, the frequency with which an action has been performed may be recorded to generate a record of the frequency with which the care giver attends to the individual. Moreover, the amount of time which elapses between the occurrence of an undesired condition and the performance of an action to alleviate or attend to the condition may be recorded. Thus, the duration the detected condition must be endured by the monitored individual may be determined. For example, the recording device may record the time taken by the care giver to attend to a detected condition such as wetness caused by enuresis. The alacrity with which the care giver responds to alleviate such an undesired and uncomfortable condition reflects on the quality of care being given to the monitored individual. Alternatively or additionally, the recording device may record the frequency with which the position of a patient is modified to prevent bedsores so that frequency and quality of care may be monitored.

In order to ascertain the information recorded by the above-described recording device, a reader device is provided which permits reading of the recorded information. The reader device may be provided in any desired configuration. For example, the reader device may be housed in the primary monitoring device housing and may be in the form of a display screen or other convenient form which permits inspection and review of the information recorded by the recording device. Alternatively or additionally, a reader device may be associated with a recording device in a housing separate from the primary housing. In yet another embodiment, the recording device may be provided in the primary housing, yet the reader device may be housed in a separate reader housing. If desired, the recorded information may be transmitted to a remote location at which a reader device is provided to display any or all of the transmitted recorded information. As one of ordinary skill in the art will appreciate, the exact form of the reader device is not to be limited to any particular form, so long as a desired information reading function is provided.

The provision of a processing means as described above is particularly useful in a monitoring system with recording capabilities. The processing means preferably is configured to control not only recording of information but also the functioning of the device, such as by controlling the sensor and/or the indicator. The processing means may include one or more programs or subroutines for controlling various features or elements of the monitoring system. For example, a computer program may be provided to monitor and to control the functioning of the sensor and to send signals from the sensor to an indicator, as described above. The use of a processing means has a variety of benefits, including integration of components and their respective functions, increased speed and power saving capabilities, and reduced size and power requirements. In particular, hard-wired circuits configured to control the monitoring and indicating functions of the monitoring system require a board of sufficient size to hold the necessary components. In contrast, a processing means may provide the necessary circuit components in a small, compact package which typically processes information much faster than possible with hard-wired circuit components. Instead of each functional device of the monitoring system having an associated circuit component, as would be required in a hardwired control circuit, a single processing means can control more than one functional device. Moreover, hard-wired circuits may require power sources in larger packages, such as AA sized batteries, whereas a processing means may be powered by a smaller power source such as a button battery. Furthermore, a processing means may be programmed to have power saving features, such as a watchdog which places the processing means into a sleep mode for a predetermined amount of time between checking if the condition being monitored has been detected.

Exemplary monitoring systems formed in accordance with the principles of the present invention will now be described with reference to the figures. It will be appreciated that features described with respect to one embodiment typically may be applied to another embodiment, whether or not explicitly indicated. The various features hereinafter described may be used singly or in any combination thereof. Therefore, the present invention is not limited to only the embodiments specifically described herein.

A monitoring system 10 formed in accordance with the principles of the present invention is shown in FIG. 1. Monitoring system 10 preferably includes a compact primary housing 12 carrying a sensor 14 and an indicator 16. Primary housing 12 should be formed from a material resistant to corrosion or other adverse effects caused by the occurrence of the condition being monitored by monitoring system 10. It will be appreciated that the sensor 14 and indicator 16 shown in FIG. 1 are exemplary only, and various modifications, such as to location, configuration and relation with respect to primary housing 12 may be made. For instance, indicator 16 need not be physically coupled to primary housing 12 but may, instead, be positioned at a care giver workstation which is remote from the individual monitored by monitoring system 10.

Preferably, monitoring system 10 is compact and relatively lightweight and may be designed to be worn comfortably by an individual. Accordingly, primary housing 12 preferably includes an attachment element 18, such as a clip, by which primary housing 12 may be attached to the individual's garments or other element through which the undesirable condition being monitored may be detected by sensor 14. Primary housing 12 and sensor 14 preferably are configured to be attached to the garments of the wearer at a location suitable for sensor 14 to extend to a position from which sensor 14 may detect soiling. Primary housing 12 may be formed so that a self-sufficient wearer desiring privacy may wear monitoring system 10 without anyone else noticing the presence of monitoring system 10. For example, compact monitoring system 10' of FIG. 2 has a primary housing 12' with a thin, compact design not larger or heavier than a commercially available pager unit and has a compact sensor design, described in further detail below.

Sensor 14 preferably is configured to detect readily an undesired condition. For instance, sensor 14 may be a wetness detecting; sensor configured to detect wetness of a surface, such as clothing, undergarments, or bed sheets, indicative that the wearer has experienced an enuresis episode. Preferably, the sensitivity of sensor 14 is set so that false signals are not generated. For example, the sensitivity of a wetness detecting sensor may be set such that a predetermined amount of wetness is required so that false signals, such as may be caused by perspiration, are not generated.

Sensor 14 may detect the occurrence of a monitored condition in any desired manner. For instance, sensor 14 may be designed to generate a detection signal only when the condition, such as wetness, is detected. In an alternate embodiment, sensor 14 may be designed to generate continuous signals until the monitored condition is detected. If the sensor generates a continuous signal, the sensor is monitored and when a signal has not been detected for a predetermined amount of time, a signal is emitted indicating that the monitored condition has occurred. Because the sensor is continuously conducting, if the sensor ceases to function, conduction will stop and a signal should be generated that the sensor is not functioning properly, unlike the earlier-described sensor which does not conduct continuously.

Sensor 14 may have any desired configuration permitting the desired sensing function to be suitably performed. It will be appreciated that the sensor configuration is selected based on the condition to be detected, and is not limited to only those illustrative embodiments described herein. For example, a sensor which may be used with monitoring system 10 may have two conductive elements (formed by any desired conductive material, such as metal) spaced apart by a nonconductive element. Contact with an element indicating the occurrence of a monitored condition causes a circuit including the two conductive elements to close and thereby cause the sensor to generate a detection signal. An example of such a sensor, configured to detect wetness, is shown in FIG. 1. Wetness detecting sensor 20 includes a conductive ring 22 (such as a metal ring) on a nonconductive probe element 24 (such as made of plastic), and a strain relief spring or other conductive element 26. Any other sensing device capable of detecting moisture and generating a signal upon such detection may be used for wetness detecting sensor 20, as known in the art, may be used instead. Preferably, the sensor is a reusable type of sensor which may be dried between wetness detections.

Figure 2:
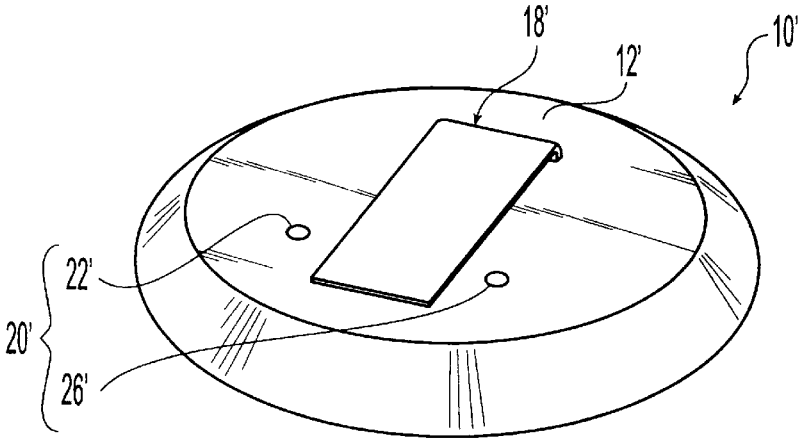
FIG. 2 shows a monitoring system similar to that of FIG. 1 but with a more compact housing.

In compact monitoring system 10' of FIG. 2, sensor 20' is formed by two spaced apart conductive elements 22' and 26' mounted on nonconductive housing 12'. Conductive elements 22', 26' may be any conductive element which will not cause discomfort to the wearer of monitoring system 10', such as two rivets or screw heads coupled together such that the presence of the element to be detected by sensor 20', such as urine, between conductive elements 22', 26' completes the sensor circuit. The attachment device 18 serves not only to attach monitoring system 10' to the desired monitoring location but also to place conductive elements 22', 26' in contact with the material through which the monitored condition may be detected. For instance, if monitoring system 10' is to be worn by an individual suffering from incontinence, then housing 12' may be coupled to the individual's garments with conductive elements 22' and 26' positioned to readily detect wetness upon enuresis.

Sensor 14 sends a detection signal to indicator 16 which indicates whether the monitored condition has occurred or has been detected by sensor 14. The signal detection may be a continuous or intermittent signal, in any desired form capable of adequately conveying the appropriate information to indicator 16. Moreover, the signal may be conveyed via a hardwired connection between sensor 14 and indicator 16 or via wireless transmission (e.g., radio frequency or infrared). Such signal may be used for various purposes, including actuating indicator 16 to provide its own signal indicating that the monitored condition has been detected.

The indicating signal which indicator 16 generates may be one which only the wearer may detect, such as a vibration. The use of a preferably lightweight vibrating device as an indicator is particularly desirable in a compact, discretely configured housing. Thus, if compact monitoring system 10' of FIG. 2 is designed as a discrete unit not readily noticed by an individual other than the wearer, the indicator thereof preferably is a vibratory motor.

It will be appreciated that indicator 16 may instead be designed for providing a signal which is readily detected by a third-party care giver such as an auditory alarm or a visual signal. For example, indicator 16 may be in the form of or at least include one or more lights 30, such as light-emitting diodes (LEDs) 32, 34. Each LED preferably is an ultrabright or superbright LED which emits over 1000 millicandelas so that actuation may be readily seen in ambient light. Preferably, a separate LED is provided for each condition being monitored, as will be described in more detail below. At least one such LED preferably is provided to indicate each condition detected by sensor 14. A separate LED may be provided to indicate whether monitoring system 10 is on or off.

If monitoring system 10 is to be used on bedridden individuals or on individuals under the care of care givers stationed at a workstation, then indicator 16 preferably is configured to transmit a remote signal to the workstation. For example, indicator 16 may include a transmitter 36 which emits a wireless signal, such as a radio signal, received by a receiver at the workstation or at any other desired location. A receiver at a location readily monitored by the care giver receives the signal from indicator 16 and indicates detection of the monitored condition. Thus, signals from indicator 16 may be monitored centrally and the care giver need not be in the immediate vicinity of the individual to be monitored in order to be alerted to detection of the monitored condition. Moreover, such signals may be centrally recorded (either manually or by a recording device as described in greater detail below) for record-keeping purposes.

In one embodiment of the present invention, monitoring system 10 may be configured to monitor two conditions. For example, monitoring system 10 may be configured to detect enuresis as well as the amount of time elapsed since the wearer's physical position has been adjusted or the individual has been turned in bed, such as to prevent bedsores or decubitus ulcers (the latter function hereinafter referenced, for the sake of simplicity, as providing a turn alert). Care givers thus are able to observe two conditions at the same time and place, namely, whether the individual is wet and whether the individual needs repositioning or turning. Provision of a turn alert in monitoring system 10 provides a timer which is clearly associated with the individual being monitored, which is not possible if the timer is positioned at the care giver's workstation (as is common). If the individual is in a wheelchair which may be moved around, then monitoring system 10 may accompany the individual so that the proper time for adjusting the individual's position is not forgotten (which may occur if the turn alert monitoring device does not accompany the individual and generates a turn alert remote from both the individual and the care giver).

In an embodiment configured to detect an enuresis episode as well as the appropriate time to move or turn an individual, preferably two sensors are provided. The first condition, enuresis, may be monitored by a first sensor 14 in the form of a wetness detecting sensor, such as described above. When the first condition is detected, a first indicator associated with the first sensor is activated. For example, an LED 32 may be provided to light up when wetness is detected by first sensor 14. Indicator 16 may automatically turn off upon drying, or a reset button, may be provided. The second condition may be monitored by an internal timer device, such as known to those of skill in the art, to indicate that a predetermined amount of time has elapsed after which the individual is to be repositioned or turned (hereinafter referenced as the "turn time" which has elapsed for the sake of simplicity). Preferably, a separate indicator, is provided to indicate that the predetermined turn time has elapsed. For example, a second LED 34 may be provided to light up after the turn time has elapsed to notify the care giver that the individual's position should be adjusted or the individual should be turned. A reset button 40 may be provided at any desired position on or with respect to housing 12, or at a remote location for remote activation, to reset the turn timer once the care giver has attended to repositioning or turning the individual.

The indicators for the two conditions being monitored preferably are distinguishable from each other so that the occurrence of one condition is not confused with the occurrence of the other condition. For example, LEDs 32 and 34 may be of different colors, such as yellow and red. Alternatively, the two indicators may be two different types of indicators, such as a visual indicator and an audible indicator.

In order to conserve energy and power source life, monitoring system 10 may be provided with a control switch 42 capable of turning monitoring system 10 on or off. In one embodiment, control switch 42 has, in addition to an on position and an off position, a test position in which all indicators are activated to ascertain that the indicators are functioning properly. As will be appreciated and as described in further detail below, the control circuitry of monitoring system 10 may be configured to have built-in energy conserving features which obviate the need for an on/off switch for the entire device.

Monitoring system 10 may be configured to monitor only one of several conditions at a time. A disable switch may be provided to disable monitoring of a condition which need not be monitored at a given time. Thus, reset button 40 or control switch 42 may function as a disable switch configured to disable at least one sensor/detector pair associated with detecting and indicating a particular condition.

Although a simple circuit may be provided to send a signal from wetness sensor 14 to indicator 16, in a preferred embodiment the control circuitry for monitoring system 10 includes a processing means as described above. The use of a processing means to control monitoring system 10 permits monitoring system 10 to be compact and to include various energy saving features which will be appreciated with further reference to alternate features and embodiments of the present invention. It will be appreciated that the indicated circuit component values of control circuits described hereafter are illustrative only. Moreover, it will be appreciated that the circuits and control programs described hereafter are illustrative only, the desired functions of the monitoring system of the present invention being capable of being performed in any other desired manner.

Figure 3:
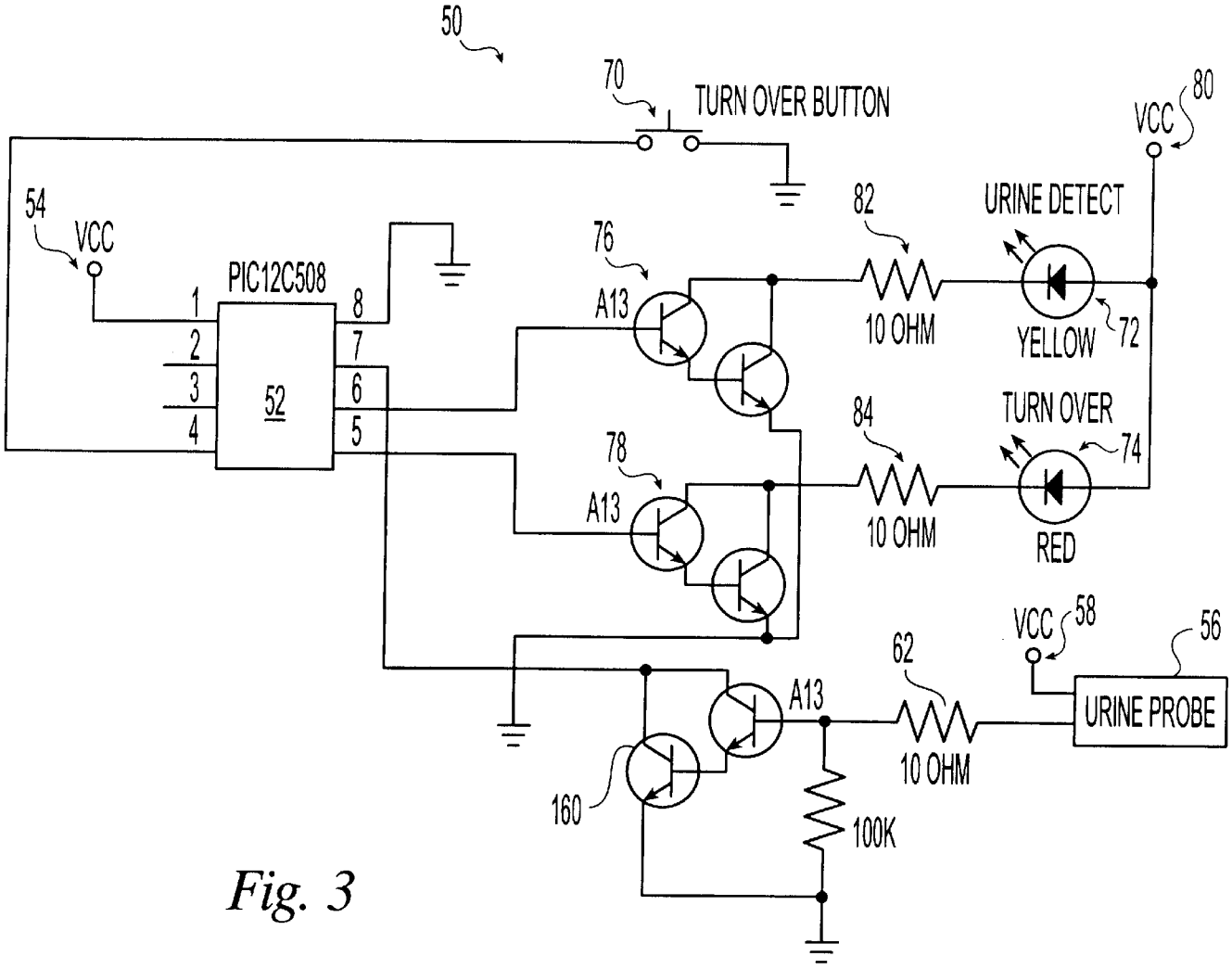
FIG. 3 is a block diagram of an exemplary circuit for controlling a monitoring system formed in accordance with the present invention.

An exemplary use of a processing means to control a monitoring system is shown in the exemplary block circuit diagram 50 of FIG. 3. Block circuit diagram 50 shows the control circuit for a monitoring system configured to monitor enuresis as well as to monitor turn time to provide a turn alert. Block circuit diagram 50 includes a processing means in the form of microprocessor 52 (although any other processing means or device capable of performing the functions described herein, such as a microcontroller may be used instead) powered by a low power energy source 54 such as a three-volt button cell battery. As will be appreciated, the appropriate connections to ground are provided.

Microprocessor 52 preferably is selected to have relatively low power requirements and preferably also to have a sleep mode. Additionally, microprocessor 52 should have sufficient memory to store an appropriate control program designed to control monitoring system 10, as described below. Microprocessor 52 need not have many pins, eight pins typically being sufficient. An exemplary microprocessor which may be used is a PIC 12C508 microcontroller (which includes a microprocessor as well as additional components) manufactured by Microchip of Chandler, Ariz. Such microcontroller has a current draw of approximately two (2) milliamps and includes a watchdog which places the microcontroller in a sleep mode for a predetermined amount of time after which the watchdog awakens the microcontroller to check the state of its pins. For example, the watchdog may be set to wake up the microcontroller every one-fifth of one second. Additionally, the PIC 12C508 has a 512 byte memory, which should be sufficient for a typical program appropriate for controlling a monitoring system formed in accordance with the principles of the present invention.

Block circuit diagram 50 also includes several components coupled to microprocessor 52 to form the control circuit for the monitoring system. Wetness detector or urine probe 56 is coupled to an input pin of microprocessor 52, such as pin 7. Probe 56 is coupled to a power source 58 to provide the necessary power for proper operation of probe 56. If desired, power source 58 may be the same as the power source provided for microprocessor 52. Preferably, a darlington pair 60 is provided to amplify the current from probe 56 at pin 7 when urine probe 56 detects wetness. A circuit component such as a resistor 62 may be provided to protect against a short in probe 56 which would cause power source 58 to be directly coupled to the base of darlington pair 60 and destroy darlington pair 60.

Another input pin of microprocessor 52, such as pin 4, receives input from a reset switch 70 which is depressed after attendance to a turn alert. The turn alert timer which actuates the turn alert may either be a separate component of the circuit, an internal timer of microprocessor 52, or a part of the control program stored in and run by microprocessor 52. The turn alert timing function may be implemented in any desired manner, such as by counting up to a pre-set turn time, counting down to zero from a pre-set turn time, or by checking actual time elapsed on a real-time clock to determine that the turn alert timer has been reached. Depression of reset button 70 sends a signal to microprocessor 52 to reset the turn alert timer which monitors the amount of time which has elapsed after the individual wearing the monitoring system has last been moved or turned. If desired, reset button 70 may be configured as a multi-functional button which not only resets the turn alert timer, but also may turn the turn alert timer on or off. For example, if reset button 70 is depressed for a predetermined period of time, then the on/off state of the turn alert timer is changed, i.e., upon depressing reset button 70 for the predetermined period of time, if the turn alert timer is on (to provide a turn alert function) it will be turned off, and if the turn alert timer is off it will be turned on. If reset button 70 is depressed for a period of time shorter than the predetermined period of time, then the turn alert timer is reset but left in the same on or off state. It will be appreciated that depression of reset button 70 for a predetermined duration may instead be interpreted as a reset command, with a shorter depression of reset button 70 being interpreted as a command to change the on/off state of the turn alert timer.

The output pins of microprocessor 52 are coupled to appropriate indicator components. It will be appreciated that the pins selected for output/input in the block circuit diagram of FIG. 3 are exemplary, other setups being within the scope of the present invention. As shown in the block circuit diagram of FIG. 3, output pin 6 is coupled to send a signal to turn on urine detect LED 72 upon detection of urine by probe 56, and output pin 5 is coupled to send a signal to turn alert LED 74 after a predetermined time has elapsed. LEDs 72, 74 are powered by power source 80, which may be the same as the power source provided for microprocessor 52. After the wetness detecting probe 56 has been dried, probe 56 stops conducting and microprocessor 52 sends a signal via output pin 6 to turn off urine detect LED 72. Similarly, after a care giver has responded to the turn alert and has depressed reset button 70, microprocessor 52 changes the state of pin 5 to low, thus turning off turn alert LED 74. Typically, a component which provides the requisite current gain for input of a signal from microprocessor 52 to LEDs 72, 74 is provided. An amplification component preferably is selected for appropriate control by the software program run by microprocessor 52. For example, as shown in FIG. 3, darlington pairs 76, 78 are provided to provide the requisite gain for respective LEDs 72, 74. Resistors 82 and 84 preferably are provided between LED 72 and darlington pair 76 and between LED 74 and darlington pair 78, respectively, to limit current flow, as known in the art.

As indicated above, microprocessor 52 contains a control program designed to control the functioning of the components of the monitoring system in which the circuit of block circuit diagram 50 is used. The program preferably includes the following steps: checking whether probe 56 has detected wetness, activating urine detect LED 72 if wetness has been detected, checking whether the predetermined turn time has elapsed to activate the turn alert, activating turn alert LED 74 if the predetermined turn time has elapsed, checking whether the probe 56 has been dried to turn off urine detect LED 72, checking whether reset button 70 has been actuated to turn off turn alert LED 74. A flow chart 100 for an exemplary program, provided in FIG. 4, will now be described.

The control program of microprocessor 52 begins with an initialization step 102 which initializes monitoring system 10 preferably only upon initial use, such as upon powering on monitoring system 10 after having been powered off (but not after awaking from a sleep mode in which power is simply reduced but not completely off). Initialization step, 102 initializes various settings, such as certain; timer variables and the microprocessor pin setup (as either input or output). This step need not be repeated during normal operation of the control program.

The first step to be performed during normal operation of the control program is query 104 which tests whether reset button 70 has been pressed. If yes, and reset button 70 is configured as described above to either reset or change the on/off state of the turn alert timer depending on the duration of depression of reset button 70, then the program branches to reset status subroutine 106 which determines the amount of time reset button 70 has been depressed. In step 108 of reset status subroutine 106, the button timer variable of the reset timer (the timer used to determine the amount of time reset button 70 is depressed) is initialized to the predetermined value at which depression of reset button 70 will be interpreted as an on/off signal rather than as a reset: signal (or vice versa, depending on the configuration of reset button 70, as described above). Next, query 110 tests whether reset button 70 is still being held. If not, then reset button 70 has been depressed for less than the predetermined period of time required to change the on/off state of the turn alert timer and the program branches to step 112 which resets the button timer variable and clears the LED flag (used to activate the LED, as described below). However, if reset button 70 is still being held, then the program branches to step 114 which decrements the button timer variable. If the button timer variable is still not at zero, as determined by query 116, then the loop including steps 110, 114, 116 is repeated until either reset button 70 is no longer depressed (and the pressing of reset button 70 is interpreted as a reset command by step 112, and step 112 performs the steps described above), or the button timer variable finally reaches zero. If the button timer variable has reached zero, then the pressing of reset button 70 is interpreted as an on/off signal and step 118 changes the on/off state of the turn alert timer. It will be appreciated that the steps of subroutine 106 are exemplary, various other implementations being within the scope of the invention.

After completion of reset status subroutine 106 (either after step 112 or step 118), the program continues with query 120, which tests whether urine is present. It is noted that if query 104 determines that reset button 70 has not been pressed, then the program continues with query 120 without branching to reset status subroutine 106. If it is determined that urine is present (such as by receiving a signal from probe 56), then the program branches to step 122 which sets the appropriate urine flag (applied later in the program) to indicate that urine has been detected. After step 122 or if urine has not been detected (the "no" branch of query 120), the urine flag is cleared at step 123 and the program continues with query 124 which tests if the turn alert timer is enabled for operation. If yes, then the program branches to turn alert timer subroutine 126 which checks whether the turn time has elapsed to activate the turn alert (indicating that the turn time has elapsed and the patient therefore should be repositioned or turned).

Figure 4:
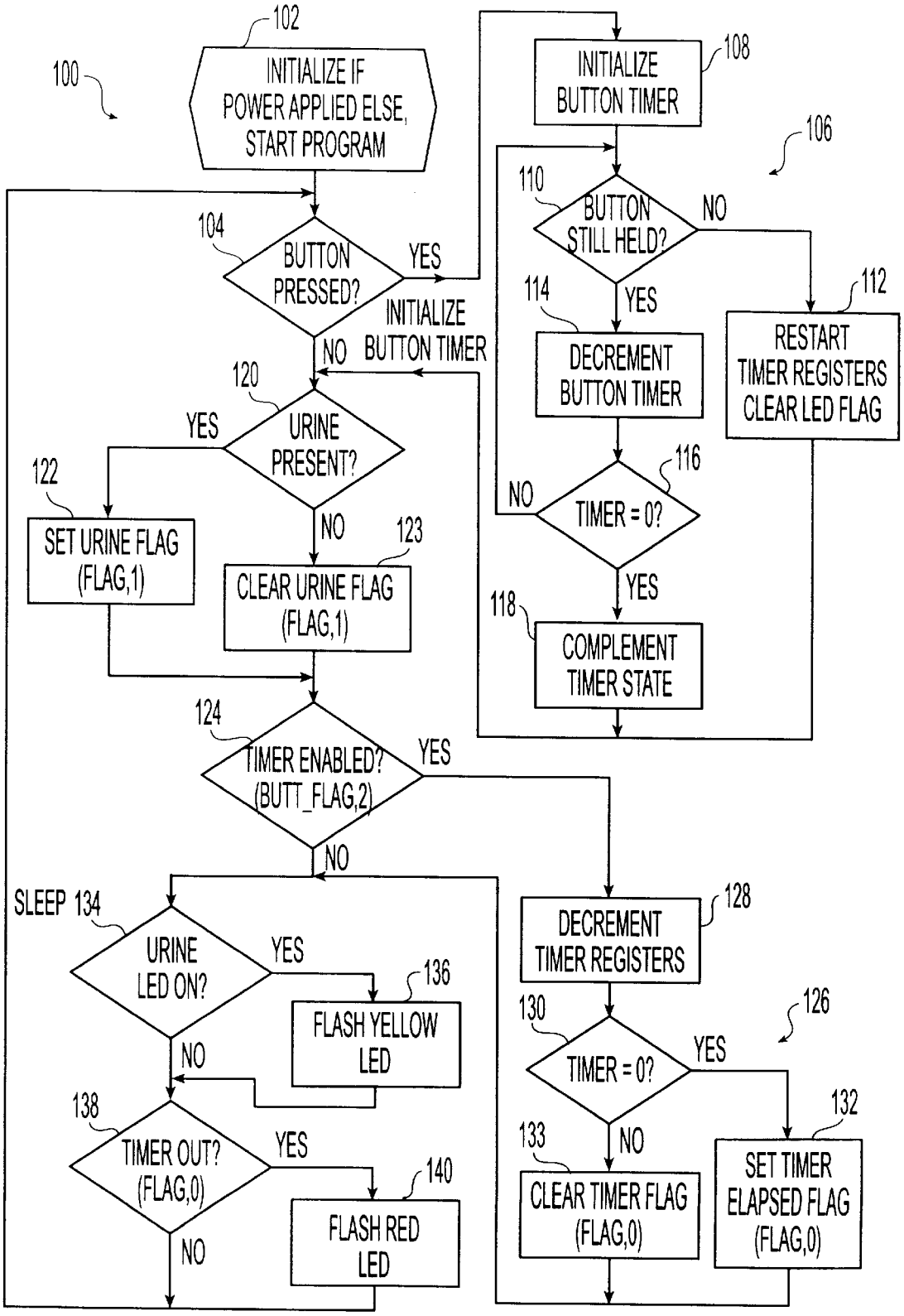
FIG. 4 shows a flow chart illustrating steps which may be performed by the circuitry of FIG. 3 to control a monitoring system formed in accordance with the present invention.

The first step 128 of the exemplary turn alert timer subroutine 126 illustrated in FIG. 4 involves decrementing the turn alert timer register. Next, the program tests, at query 130, whether the turn alert timer has reached zero. If not, the program clears the turn alert timer elapsed flag and returns to the main routine. If yes, then the predetermined amount of time has elapsed and the subroutine branches to step 132 to set a turn alert timer elapsed flag to be used later in the program. It will be appreciated as discussed above, that the turn alert timer may perform its timing function in any of a variety of manners, such as by counting up to a pre-set turn time, counting down to zero from a pre-set turn time, or by checking actual time elapsed on a real-time clock to determine that the turn alert timer has been reached.

After either a "no" response to query 130 or after step 132 is performed, the program tests, at query 134, whether the urine flag is on. If yes, then the program branches to step 136 to cause the appropriate LED (e.g., yellow) or other indicator to be turned on. After step 136, or if the urine flag is not on, the program next tests, at query 138, if the timer elapsed flag is on or off. If yes, then the program branches to step 140 to send a signal to turn on the appropriate LED (e.g., red) or other indicator. After step 140, or if the timer elapsed flag is not on, the microprocessor is caused to enter sleep mode for a predetermined amount of time. After such predetermined amount of sleep time has elapsed, the program returns to the beginning of the routine at query 104 and continues with the above-described steps and queries 106–140.

As will be appreciated, the above-described use of a microprocessor to control detection of wetness as well as to monitor the amount of time which has elapsed since the individual's position has been adjusted has a variety of benefits over hard-wired circuits. For instance, the necessary timers are integrated into the microprocessor by being incorporated into the control program. Thus, a separate timer requiring additional power is unnecessary. Additionally, such a microprocessor controlled circuit is more compact than a traditional hard-wired circuit. Moreover, because microprocessors are run by programs, future changes may be implemented by changing the program, which is a simpler task than changing the wiring of a hard-wired circuit. Programs and/or software in microprocessors are also capable of being debugged more easily than correcting a mistake in a hard-wired circuit, particularly in the case of mass production.

A monitoring system in which the indicator is a vibrating device also benefits by being controlled by control circuitry including a: microprocessor. As described above, the use of a microprocessor permits a compact control circuit design. Thus, the use of a microprocessor further facilitates the formation of a compact and thus discrete monitoring system, as would be desirable particularly with a monitoring system having a discrete indicator like a vibrating device. It will be appreciated that a compact monitoring system such as device 10' of FIG. 2 would likewise benefit from the provision of a microprocessor to control functioning thereof, whether or not the indicator is a vibrating device. Because a vibrating device tends to consume more energy than other typical indicators such as LEDs, the use of a microprocessor is particularly beneficial for the control of a vibrating device indicator because a microprocessor may run the vibrating device in an energy saving manner.

Figure 5:
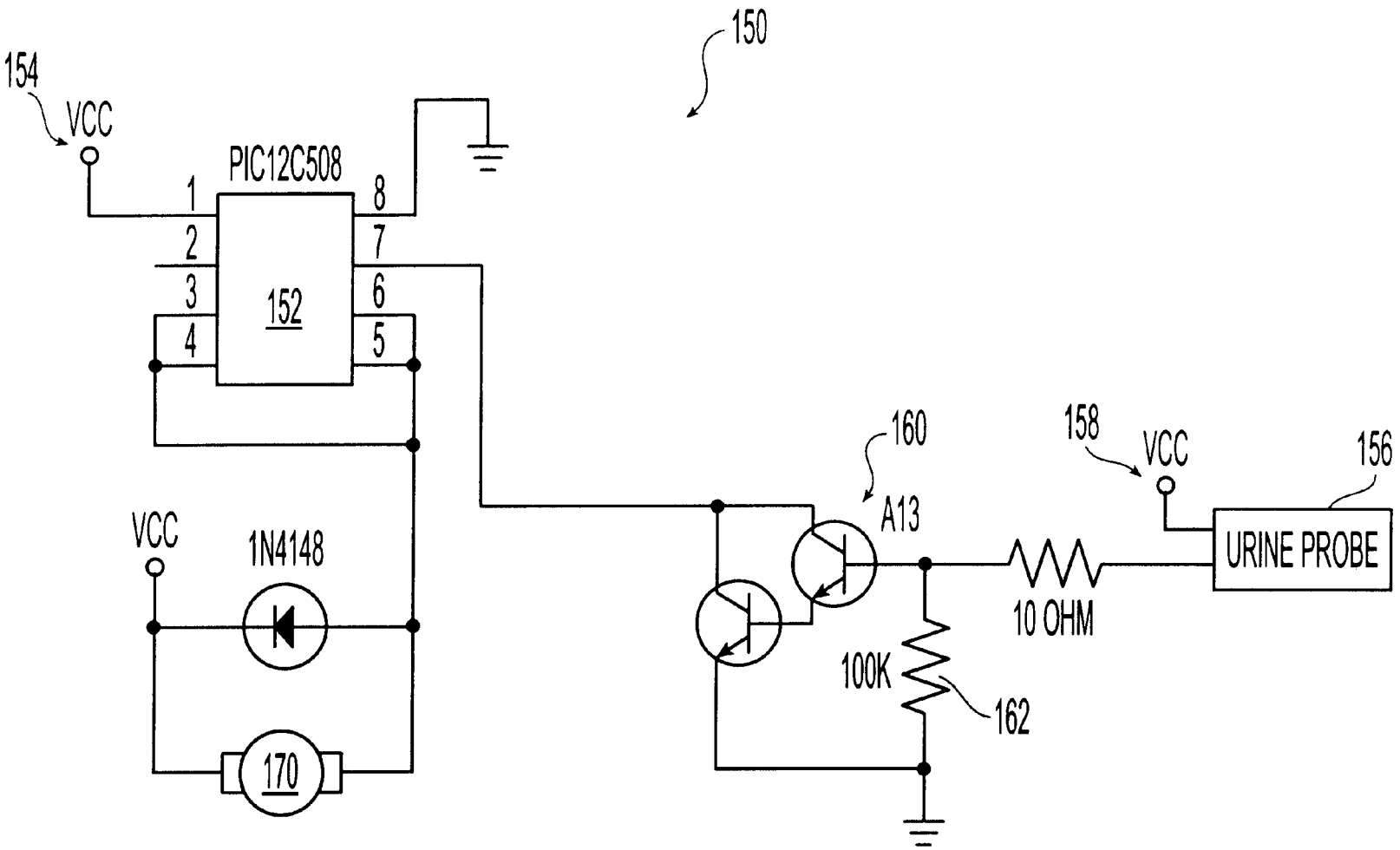
FIG. 5 is a block diagram of an exemplary circuit for controlling another embodiment of a monitoring system formed in accordance with the present invention.

An exemplary use of a processing means to control a monitoring system having a vibrating device indicator is shown in the exemplary block circuit diagram 150 of FIG. 5. The monitoring system of block circuit diagram 150 is configured to monitor enuresis. However, other sensors may be used instead without departing from the principles of the present invention. Block circuit diagram 150 includes a processing means in the form of a microprocessor 152 (although any other device processing means or device capable of performing the functions described herein may be used instead) powered by a low power energy source 154 such as a three-volt button cell battery. As will be appreciated, the appropriate connections to ground are provided. Microprocessor 152 is selected to have the appropriate power and memory requirements as well a sleep mode. Preferably, a microprocessor similar to that used in above-described block circuit diagram 50 of FIG. 3 may be used.

Block circuit diagram 150 also includes several components coupled to microprocessor 152 to form the control circuit for the monitoring system. It will be appreciated that the pins selected for output/input in the block circuit diagram of FIG. 3 are exemplary, other setups being within the scope of the present invention. As shown in FIG. 5, wetness detector or urine probe 156 is coupled to an input pin of microprocessor 152, such as pin 7. Probe 156 is coupled to a power source 158 to provide the necessary power for proper operation of probe 156. Preferably, power source 158 is the same as the power source provided for microprocessor 152. A darlington pair 160 preferably is provided to amplify current from probe 156 to microprocessor 152. A circuit component such as a resistor 162 may be provided to protect against a short in probe 156 which would cause power source 158 to be directly coupled to the base of darlington 160 and destroy darlington 160.

Pins 3, 4, 5, and 6 of microprocessor 152 are coupled to power vibrating device indicator 170. All pins are preferably turned on at once in order to provide a sufficient power sink to permit vibrating device indicator 170 to function. Preferably, vibrating device indicator 170 is a pager motor which runs at a low voltage and uses relatively little current, yet runs at a speed sufficient to cause a noticeable vibration of the housing in which pager motor 170 is provided. A diode 172 preferably is provided to protect microprocessor 152 from back EMF from inductance in the motor of indicator 170.

Figure 6:
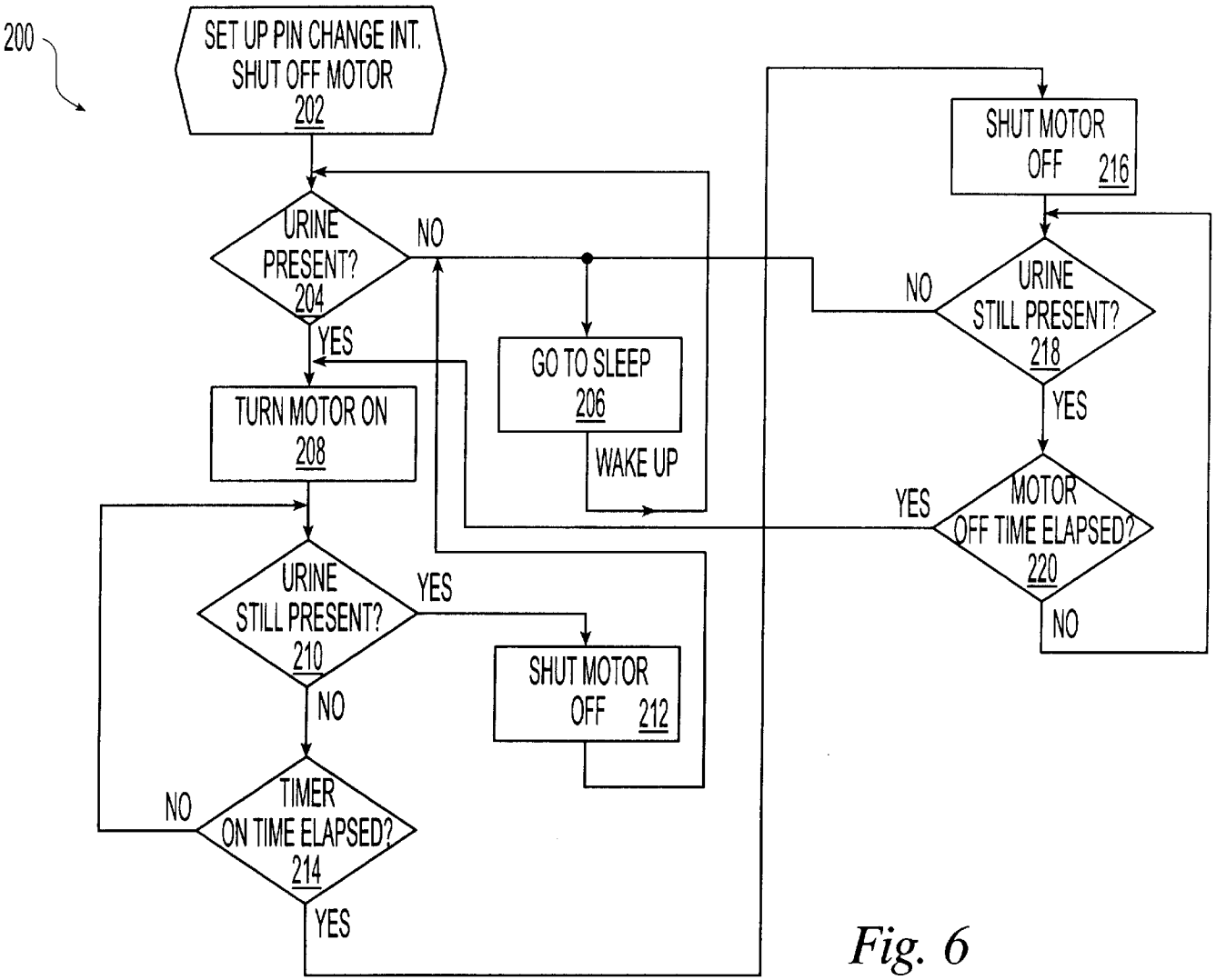
FIG. 6 shows a flow chart illustrating steps which may be performed by the circuitry of FIG. 5.

As indicated above, microprocessor 152 contains a control program designed to control the functioning of the components of the monitoring system in which the circuit of block circuit diagram 150 is used. The control program preferably includes the following steps: checking whether probe 156 has detected wetness, activating vibrating device indicator 170 if wetness has been detected, pulsing the motor to conserve energy so long as wetness is detected, and checking whether the probe 156 has been dried to turn off vibrating device indicator 170. A flow chart 200 of an exemplary control program is provided in FIG. 6, as will now be described.

The control program of microprocessor 152 begins with an initialization step 202 which initializes the monitoring system preferably only upon initial use, such as upon powering on after having been powered off (but not after awaking from a sleep mode in which power is simply reduced but not completely off). Initialization step 202 initializes various settings, such as the microprocessor pin setup (to be either input or output). This step need not be repeated during normal operation of the control program.

Preferably, microprocessor 152 which runs the control program remains in a sleep mode until wetness, such as caused by urine, is detected. Upon awakening from sleep mode, the control program tests, at query 204, whether probe 156 has detected wetness/urine. So long as wetness is not detected, microprocessor 152 remains in a sleep mode, schematically illustrated by branching to step 206 which causes the microprocessor to enter sleep mode. Microprocessor 152 wakes up after wetness is detected (e.g., the setting of the pin receiving a signal from probe 156 changes, indicating wetness has been detected and turning on/waking up microprocessor 152) to return the control program to query 204. Once wetness/urine is detected at query 204, the vibrating device indicator 170 is turned on by step 208.

Next, the program determines whether probe 156 is still wet (e.g., if urine is still present) at query 210. If no, then the program branches to step 212 at which vibrating device indicator 170 is shut off (such as by turning off a motor of a motor-driven vibrating device indicator 170), and the program returns to step 206 to return microprocessor 152 to sleep mode. If, however, wetness is still detected, then query 214 tests whether the predetermined on time for vibrating device indicator 170 has elapsed (vibrating device indicator 170 being set to vibrate only for a predetermined amount of "on" time). If the predetermined on time of vibrating device indicator 170 has not elapsed, the program returns to query 210. So long as wetness is still present and the on time of vibrating device indicator 170 has not elapsed, the program continues to loop through queries 210 and 214.

Once the on time of vibrating device: indicator 170 has elapsed (and if urine is still present), vibrating device indicator 170 is turned off, such as to conserve energy and/or to create a pulsed vibration. The program thus continues with step 216 which turns off vibrating device indicator 170 (such as by turning off a motor thereof). Next, the program once again tests, at query 218, whether wetness is still being detected. If no, then the program branches to step 206 to return microprocessor 152 to sleep mode at step 206. The microprocessor exits sleep mode upon detection of wetness to return the control program to query 204 such as described above. If, however, wetness is still detected, then the program tests, at query 220, whether the off time of vibrating device indicator 170 (for instance, the amount of time the motor of a motor-driven vibrating device indicator 170 is to be turned off) has elapsed. The program continues to loop through queries 218 and 220 so long as wetness is still detected and the off time of vibrating device indicator 170 has not yet elapsed. Once the off time of vibrating device indicator 170 has elapsed, the program returns to step 208 to turn on the vibrating device indicator 170. The program continues on from step 208 as described above.

As will be appreciated from the above description, the use of a microprocessor to control a monitoring system which indicates detection of the condition being monitored via a vibrating device indicator has a variety of benefits. For instance, various power saving features, such as sleep mode for both the control of the monitoring system as well as of the indicator may be built into the control program, thereby providing efficient energy saving steps. Moreover, because the timer for the indicator is a part of the program, an additional timer requiring its own power source is unnecessary.

Various benefits of using a microprocessor, as opposed to a hard-wired circuit, to control the functioning of such a monitoring system are provided as described above. Another benefit of controlling a monitoring: system via a processing means is that the processing means may also be used to store detected events or conditions. The stored information may be utilized to gain a better sense of the frequency with which an undesired condition being monitored occurs and/or the alacrity with which a care giver attends to this condition. Determination of such frequency may permit preventive measures to be taken, if possible, in anticipation of the occurrence of another such undesired condition. The storage of such information is particularly useful in monitoring systems used on an individual under the care of a care giver. The stored information may be utilized to monitor care giver attendance to the wearer. For example, data pertaining to frequency and/or duration of a detected condition or event may be stored. Precise times and dates relating to the occurrence of the detected condition and/or care given to the wearer of the monitoring system may also be stored. The time elapsed between the occurrence of an undesired condition, such as enuresis or lack of physical movement for over a maximum time period (turn time), and care given by a care giver attending to the undesired condition, may thus be determined and monitored. It will be appreciated that information pertaining to conditions monitored by the monitoring system of the present invention may be stored in the primary housing of the monitoring system (the housing in which the sensor and indicator are provided) or at a remote location, such as at an administrator's office at which the information may be reviewed to monitor the care giver's performance.

Figure 7:
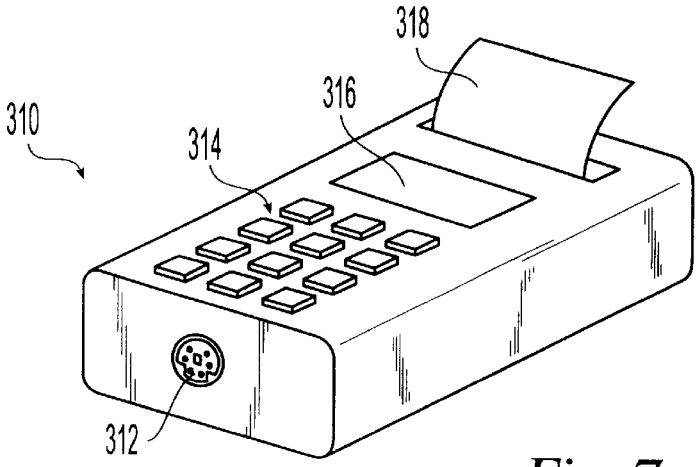
FIG. 7 shows a reader device which may be used with a monitoring system having memory storing capabilities.

Reading of the stored information may be performed in any of a number of manners known in the art. For example, the storage device in which the information is stored, such as in the memory of the processing means, may be provided in a housing which includes a display screen configured to display information read from the storage device. Alternatively, a separate reader 310, as shown in FIG. 7, may be provided to retrieve information from the microprocessor controlling the monitoring system. Thus, reader 310 preferably is provided with a dataport 312 by which signals emitted from monitoring system 10 are received. For example, dataport 312 may include a receiver for wireless signals such as radio waves emitted from monitoring system 10 or a port for a wire data bus over which electrical signals are transmitted from monitoring system 10. Dataport 312 may also be configured as a transmitter by which reader 310 may transmit control data to set the processing means of monitoring system 10. Thus, reader 310 preferably is provided with a data entry interface 314, such as a keypad. Preferably, a display screen 316 (such as a liquid crystal display screen) is provided to display information retrieved by reader 310 and/or data to be transmitted from reader 310. A record printer 318 may be provided to print a hard copy of a record of either the data received or transmitted by reader 310. It will be appreciated that a reader which is physically separate from the primary housing of the monitoring system may be a part of another system to which data from the monitoring system of the present invention may be uploaded for storage, analysis, etc.

The microprocessor of the above-described embodiments may be programmed to provide a monitoring system having data storing and transmitting capabilities. Preferably, the use of a microprocessor having such capabilities would be accompanied by the modification of block circuit diagram so that another pin is coupled to a data transmitting/receiving device as known to those of ordinary skill in the art. In such embodiment, the monitoring system includes not only a microprocessor but also a programmable memory device (e.g., either an EEPROM or as a part of a microcontroller in which the microprocessor is provided) and is referenced as a log for the sake of simplicity.

Figure 8:
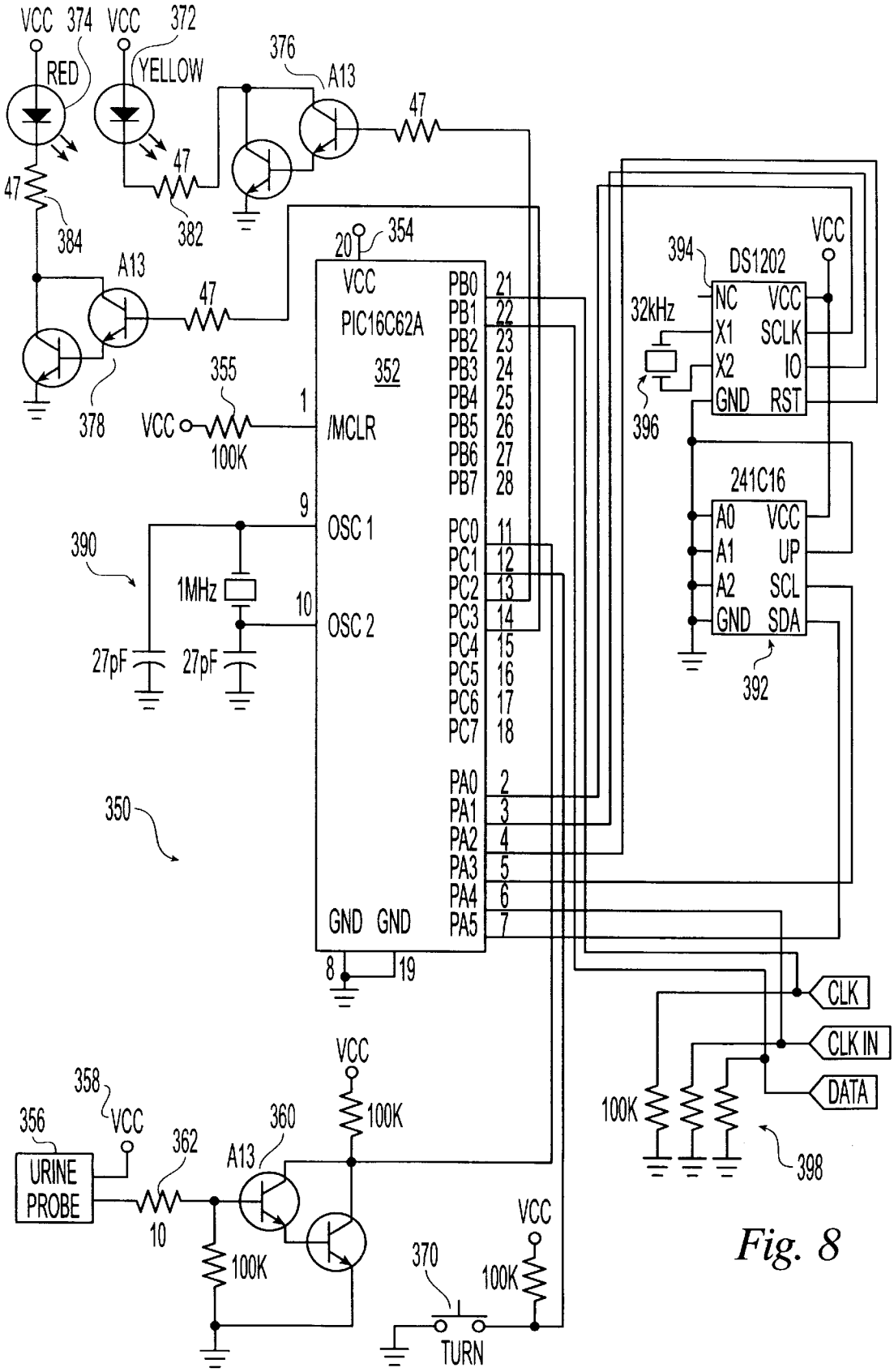
FIG. 8 is a block diagram of an exemplary circuit in a monitoring system having memory storing capabilities.

An exemplary use of a microprocessor and a programmable memory device is shown in the exemplary block circuit diagram 350 of FIG. 8. Block circuit diagram 350 shows the control circuit for a monitoring system configured to monitor enuresis as well as to monitor turn time to provide a turn alert. Moreover, the control circuit of block circuit diagram 350 is configured to provide, in real time, a record of monitored events, such as occurrence and/or attendance to enuresis, time and/or frequency of turning of the patient, etc. In order to provide such capabilities, the processing means for controlling the monitoring device and its various functions preferably is provided in a microcontroller 352 which has the capacity of controlling various other components in the circuit (although any other processing means or device capable of performing the functions described herein may be used instead). Microcontroller 352 may have any or all of the features of the microprocessors described above. Preferably, microcontroller 352 has more memory than the above-described processing means and more pins for the additional connections necessary for the memory components of block circuit diagram 350. An exemplary microcontroller is a PIC 16C62A microcontroller manufactured by Microchip of Chandler, Ariz. Microcontroller 352 is powered by a low power energy source 354, such as a three-volt button cell battery. Pull-up resistors, such as resistor 355, may be provided if microcontroller 352 does not have its own internal pull-up resistor. Moreover, a separate ceramic resonator 390 may be provided to provide a time base for microcontroller 352 if microcontroller 352 does not have its own internal oscillator.

Block circuit diagram 350 includes several components similar to those provided in block circuit diagram 50 of FIG. 3. Accordingly, for a description of elements in block circuit diagram 350 having the same reference numbers, increased by 300, as elements in block circuit diagram 50, reference is made to the description of such similarly referenced elements (differing by 300) provided with respect to block circuit diagram 50.

In addition to circuit components such as those provided in block circuit diagram 50, block circuit diagram 350 also includes a memory recording device 392, such as a programmable memory, coupled to microcontroller 352. For example, an EEPROM having sufficient memory for recording various events monitored by the monitoring device over a predetermined period of time, such as a 24LC16 EEPROM manufactured by Microchip may be used. It will be appreciated that, a separate memory recording device is not necessary if microcontroller 352 has sufficient memory capacity for the purposes of the monitoring system it services.

Additionally, a real time clock 394 preferably is provided in order to provide accurate data for recording events in recording device 392. Any desired real time clock 394 may be used. For example, a DS 1202 chip Dallas Semiconductor of Dallas, Tex. may be used to provide the time and date to be recorded in recording device 392 upon occurrence of a monitored event. If needed, a crystal 396, such as a crystal with a 32 khz frequency, may be provided to generate a square wave for utilization by real time clock 394.

Connections 398 for communicating the information stored in the memory of the monitoring system to a reader or other device which presents the stored information to a user are also provided. It will be appreciated that connections 398 may be in any desired form, such as hard-wired connections or wireless connections such as radio-frequency or infrared transmissions of data. Moreover, connections 398 preferably correspond to the requirements of the timing diagram of FIG. 13.

A flow chart 400 of an exemplary program permitting data storage and transmitting capabilities is provided in FIG. 9, as will now be described. It will be appreciated that flow chart 400 illustrates an exemplary program for controlling a monitoring system with a circuit as shown in FIG. 3 configured to monitor not only wetness but also the amount of time which has elapsed since the patient wearing the monitoring system has been repositioned or turned. The program of FIG. 9 may be modified to provide for different or additional monitoring functions, as will be appreciated by one of ordinary skill in the art.

Figure 9:
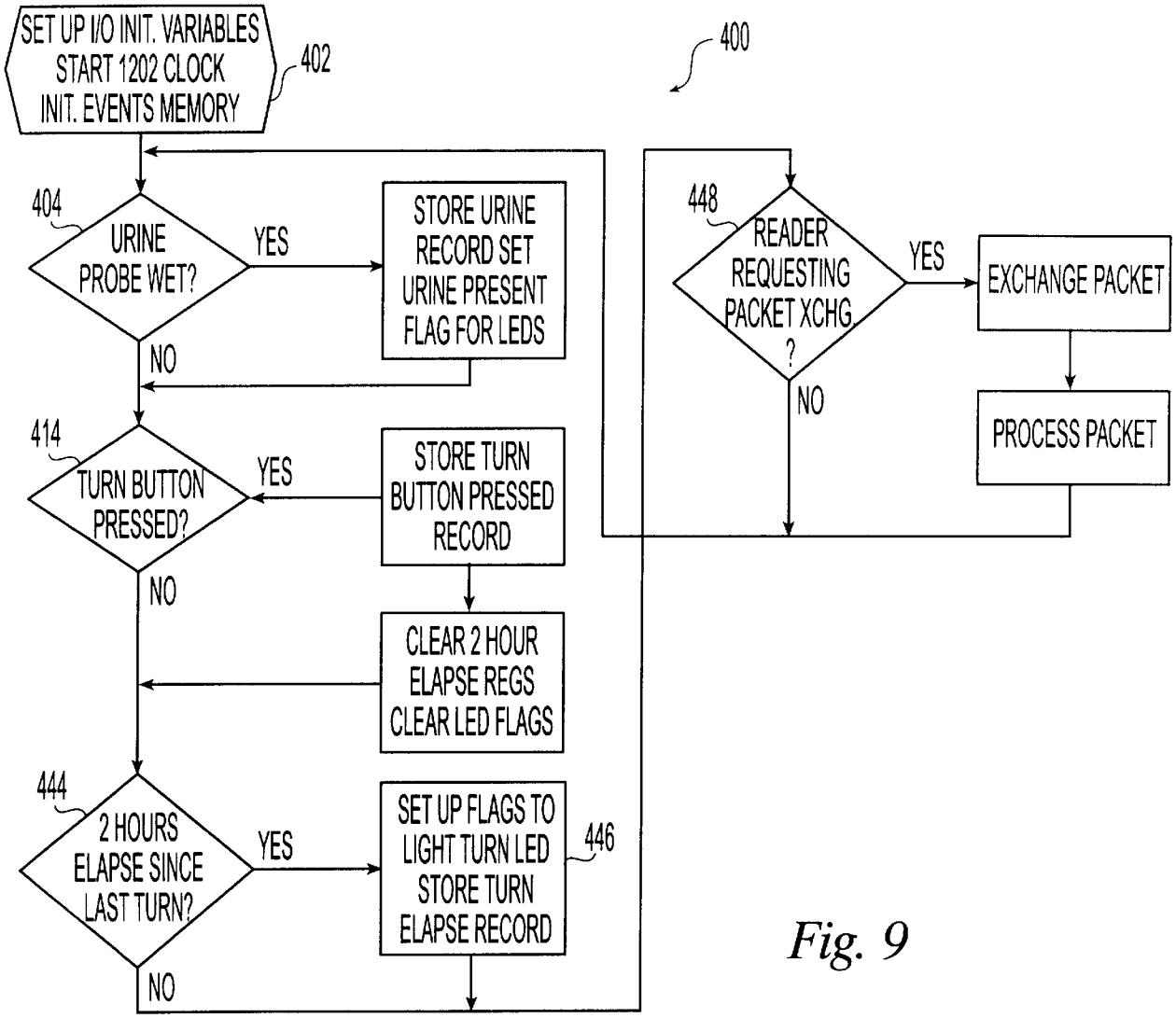
FIG. 9 shows a flow chart illustrating steps which may be performed by the circuitry of FIG. 8.

The control program of FIG. 9 begins with an initialization step 402 which initializes the monitoring system preferably only upon initial use, such as upon powering on after having been powered off (but not after awaking from a sleep mode in which power is simply reduced but not completely off). Initialization step 402 initializes various settings, such as the microprocessor pin setup (to be either input or output), memory setup, and various timer settings. This step need not be repeated during normal operation of the control program.

Figure 10:
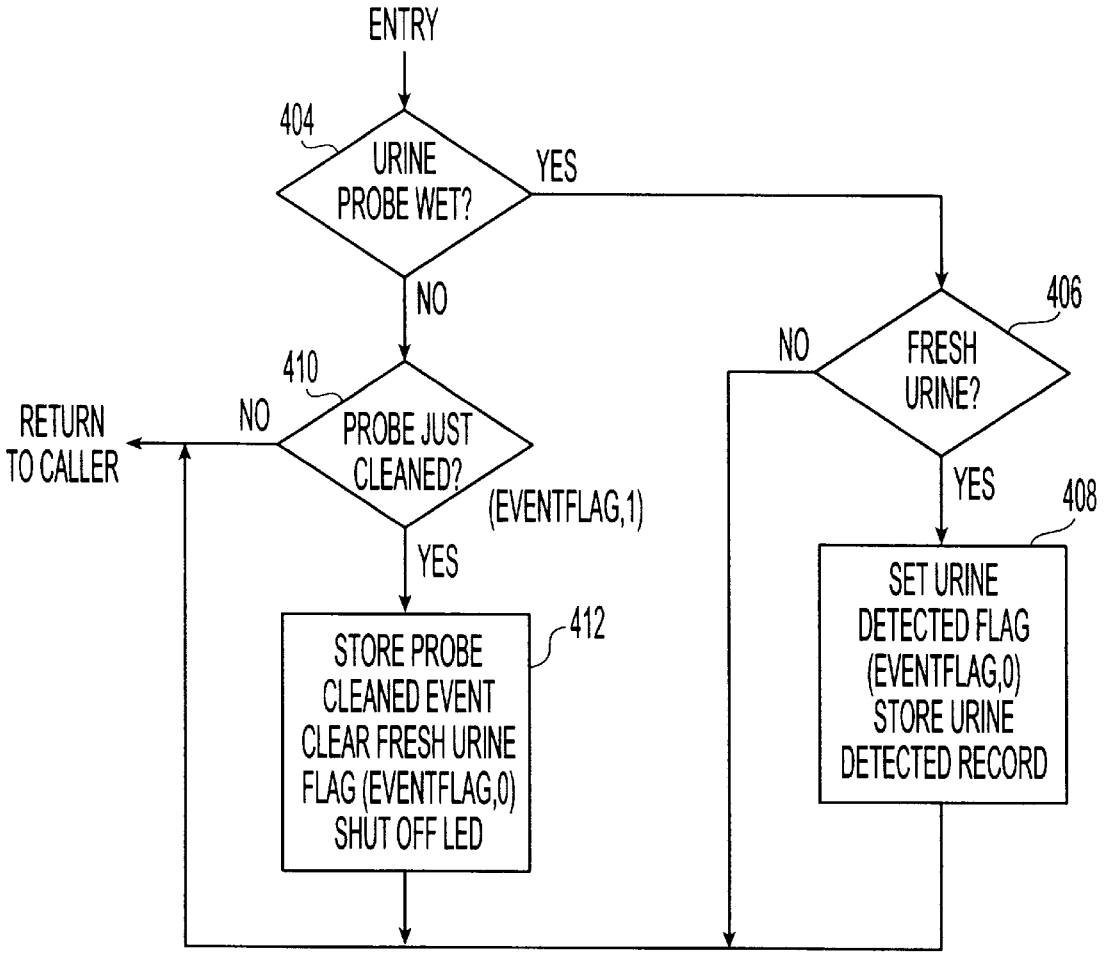
FIG. 10 shows a wetness detection subroutine of the flow chart of FIG. 9.

The first step to be performed during operation of the main body of the control program is query 404 which tests whether wetness has been detected (e.g., if probe 56 is wet). The yes and no branches of query 404 continue with subroutines shown in a simplified form in FIG. 9, but shown in greater detail in FIG. 10. With reference to FIG. 10, if wetness is detected at query 404, then the program branches to another query 406 which tests whether the detected wetness has already been detected (e.g.; whether fresh urine has been detected or whether the previously detected urine has not been dried away). If no fresh wetness has been detected (the urine has already been detected), then the subroutine returns to the main program of FIG. 9. However, if fresh wetness has just been detected, then query 406 branches to step 408 at which a urine detected flag is set, for purposes as will be described below. Additionally, a record of the detection of wetness, such as the time at which wetness was detected, is stored in memory. The subroutine then returns to the main program of FIG. 9.

If the response to query 404, testing whether wetness has been detected, is no, then the subroutine branches to query 410 to determine whether the wetness detecting probe has just been cleaned or dried. If no, then no wetness has been detected or alleviated, and the subroutine returns to the main program. However, if the probe has just been cleaned, then the subroutine branches to step 412 at which the fresh urine flag is cleared (indicating that the probe has been cleaned) and the indicator which indicates that wetness has been detected is shut off. Additionally, the cleaning of the probe (e.g., the time at which the cleaning of the probe was detected) is stored in memory. The subroutine then returns to the main program of FIG. 9.

After the subroutines associated with query 404 have been performed, the program tests, at query 414, whether reset button 70 has been pressed. The yes and no branches of query 414 continue with subroutines shown in a simplified form in FIG. 9, but shown in greater detail in FIG. 1l. Such subroutine; is typically only provided if reset button 70 is configured to function as a reset as well as an on/off control for the turn alert timer, depending on the length of time reset button 70 is depressed. As described with reference to the control program of FIG. 4, such query tests whether reset button 70 has been pressed a sufficient amount of time to change the on/off state of the turn alert timer or has been pressed to reset the turn alert timer. Although the subroutine is described with reference to depression of reset button 70 for a predetermined a mount of time being interpreted as a command to change the on/off state of the turn alert timer and a shorter depression of reset button 70 being interpreted as a reset of the turn alert timer without changing the on/off state thereof, the program may also be written for a reverse interpretation of the duration of depression of reset button 70.

Figure 11:
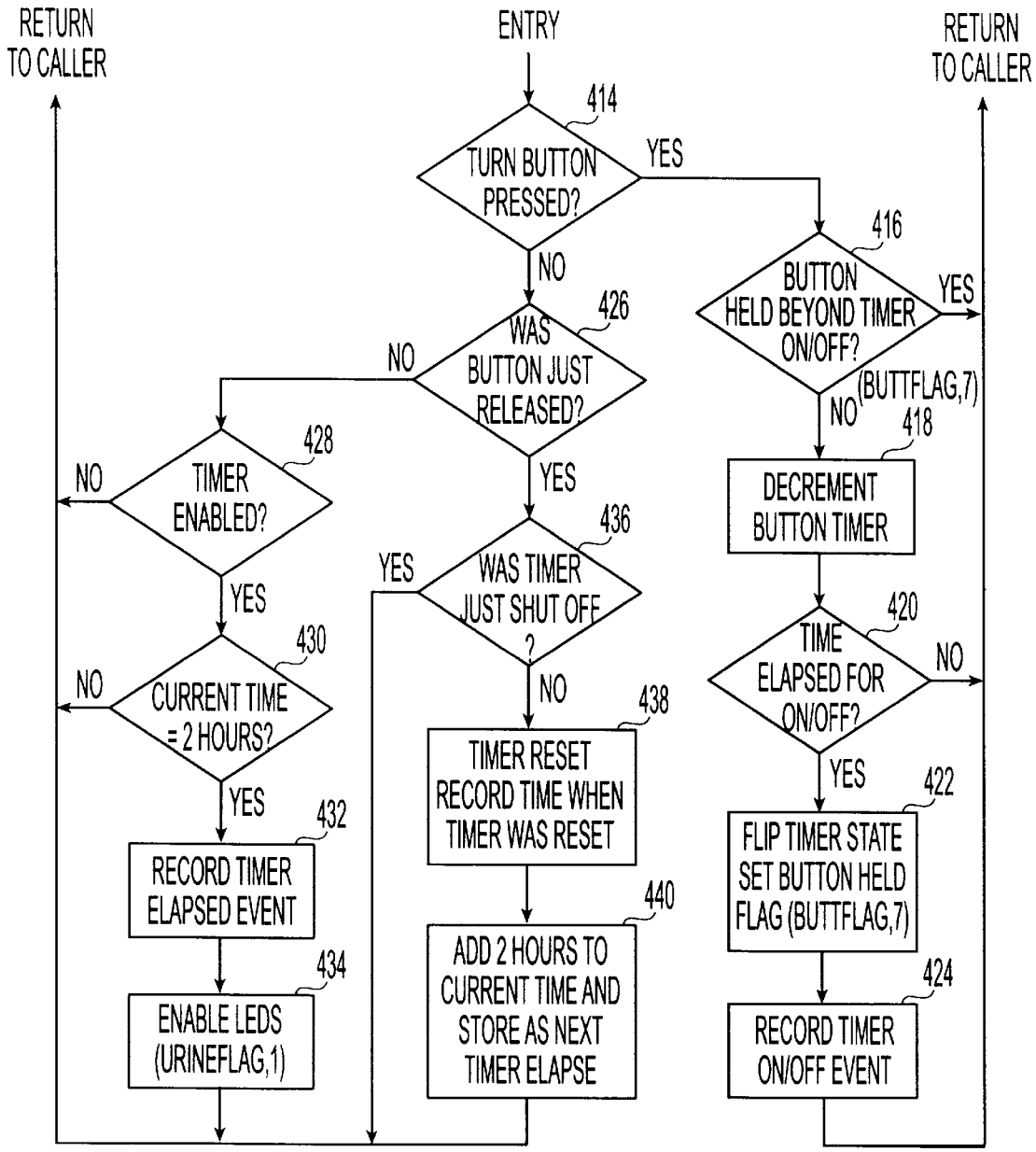
FIG. 11 shows a reset button subroutine of the flow chart of FIG. 9.

With reference to FIG. 11, the yes branch of query 414 results in testing a button held timer at query 416 to determine whether reset button 70 has been held beyond the predetermined on/off time (which would result in depression of reset button 70 being interpreted as a command to change the on/off state of the turn alert timer). If yes, then the subroutine returns to the main program of FIG. 9. However, if reset button 70 has not been depressed beyond the predetermined on/off time, then the subroutine continues with step 418 at which the button timer variable is decremented. Next, query 420 tests whether the predetermined on/off time has elapsed (whether the button timer variable has reached zero). If no, then the subroutine returns to the main program of FIG. 9. However, if the predetermined on/off time has elapsed, then the depression of reset button 70 is to be interpreted as a command to change the on/off state of the turn alert timer. The yes branch then continues with step 422 at which the turn alert, timer on/off state is changed from off to on or on to off and the turn alert on/off flag ("button held flag $buttflag_1$ 7") is set to indicate the change in state. At step 424, the change of the on/off state of the turn alert timer (e.g., the time at which the turn alert timer is turned off) is recorded. The subroutine then returns to the main program of FIG. 9.

If, instead, the answer to query 414 is no (the reset button was not pressed), then the subroutine continues with query 426 which tests whether reset button 70 has just been released. If the answer to query 426 is no, then the subroutine next determines at query 428 if the turn alert timer is even enabled for operation. If no, then the subroutine returns to the main program of FIG. 9. If yes, then the subroutine next tests, at query 430, whether the predetermined amount of time has elapsed, after which the turn alert is to be activated. If no, then the subroutine returns to the main program of FIG. 9. If, however, the turn time has elapsed, then it is time to reposition or turn the patient. At step 432, the elapse of the turn time is recorded (e.g., the time at which the turn time elapsed is recorded). At step 434, the turn alert flag is turned on to indicate that the turn time has elapsed. After steps 432 and 434, the subroutine returns to the main program of FIG. 9. Various other steps for determining whether the turn time has elapsed, as discussed above, may be performed instead.

However, if reset button 70 has just been released, then the yes branch of query 426 continues with query 436 which tests whether the turn alert timer has just been shut off. If yes, then the turn alert timer is considered to be disabled by the previous pressing of reset button 70 for the predetermined on/off time and the subroutine returns to the main program of FIG. 9. If, instead, reset button 70 was just released but the turn alert timer was not shut off, then reset button 70 was depressed for a relatively short duration in order to reset the turn alert timer. Accordingly, the no branch of query 436 continues with step 438, at which the turn alert timer is reset (i.e., the pressing of reset button 70 was to reset the turn alert timer rather than to change the on/off state) and the resetting of the turn alert timer is recorded (e.g., the time of resetting is recorded). At step 440, the turn time is set. The setting of the turn time may be accomplished in any of a variety of manners. For instance, a time at which turning, repositioning, or other task is to be performed may be based on real time. In such case, the turn time (e.g., two hours) is added to the current real time and the querying of whether the turn time has elapsed is performed by comparing real time to the time set as the turn time. The subroutine then returns to the main program of FIG. 9.

After subroutines associated with query 414 have been performed, the main program of FIG. 9 continues with query 444 which tests whether the turn alert time has elapsed (e.g., two hours have elapsed since the patient was last moved or turned and therefore the patient must be moved or turned again). If no, then the program branches to the next subroutine, as described below. If yes, then the program branches to step 446 at which a flag is enabled to turn on the turn alert indicator and to store the turn alert time elapse information in memory. The program then continues with the next subroutine.

Figure 14:
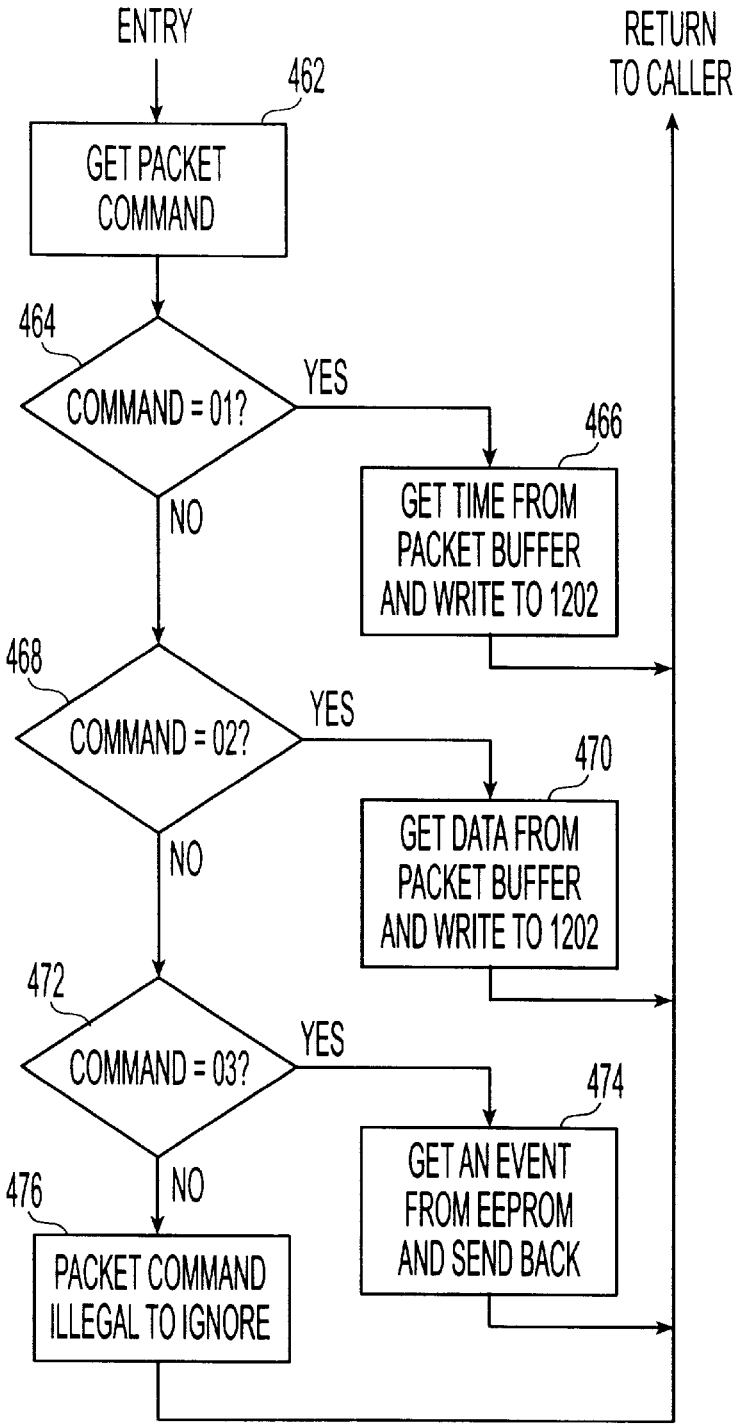
FIG. 14 shows a process packet subroutine of the flow chart of FIG. 9.

After testing whether the turn alert time has elapsed at query 444, the program then tests at query 448 whether reader 310, has requested information or has information to transmit. If no, then the program returns to the first query 404. However, if reader 310 has an information request or has information to transmit, then the program continues with an exchange packet subroutine such as shown in FIG. 12 and a process packet subroutine as shown in FIG. 14.

Figure 12:
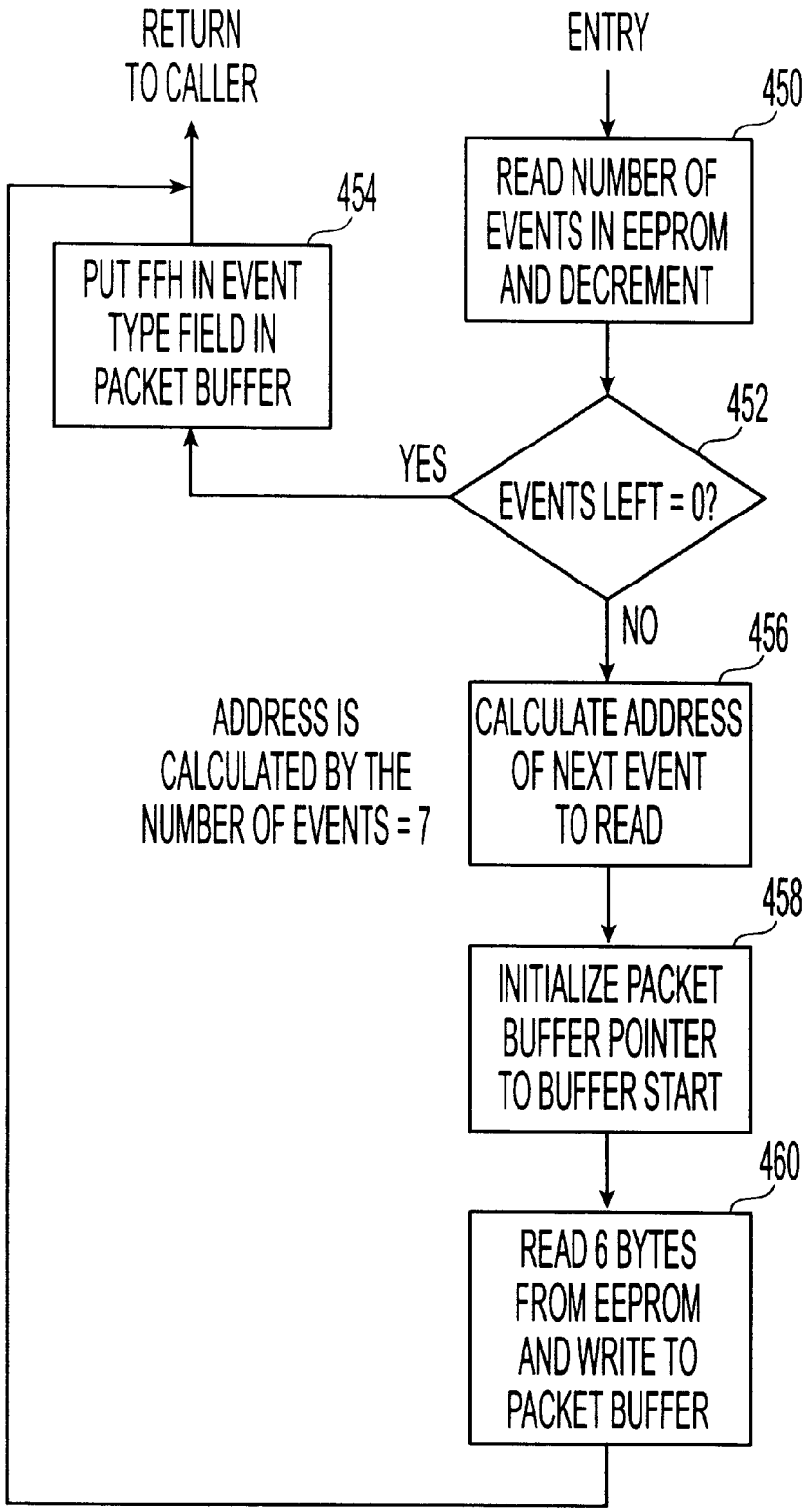
FIG. 12 shows a read event subroutine of the flow chart of FIG. 9.

The exchange packet subroutine of FIG. 12 controls the transmission of information from the memory of the monitoring system or log to the reader. The first step of the exchange packet subroutine is to read the number of records in memory at step 450 to determine how many records are to be transmitted from the log to the reader. Such records may includes such information as the type of event which has occurred (e.g., enuresis, or care such as drying or turning of the patient) and the time at which such event occurred. Next, the subroutine determines at query 452 if the number of events left to be read from memory is zero. If yes, then the subroutine branches to step 454 at which a signal is sent that no events are left to be read and the subroutine is returned to the main program of FIG. 9.

However, if there are still events to be read, then query 452 branches to step 456 at which the address of the next event to be read is calculated, such as by multiplying the number of events to be read by the number of bytes per event. The pointer in the memory buffer is then moved to the appropriate memory location at step 458. The information in memory is read, at step 460, and written to a packet buffer for transmission to the reader. The subroutine then returns to the main program of FIG. 9. It will be appreciated that additional subroutines may be performed to achieve the desired information transfer, such subroutines being readily understood by one of ordinary skill in the art.

Figure 13:
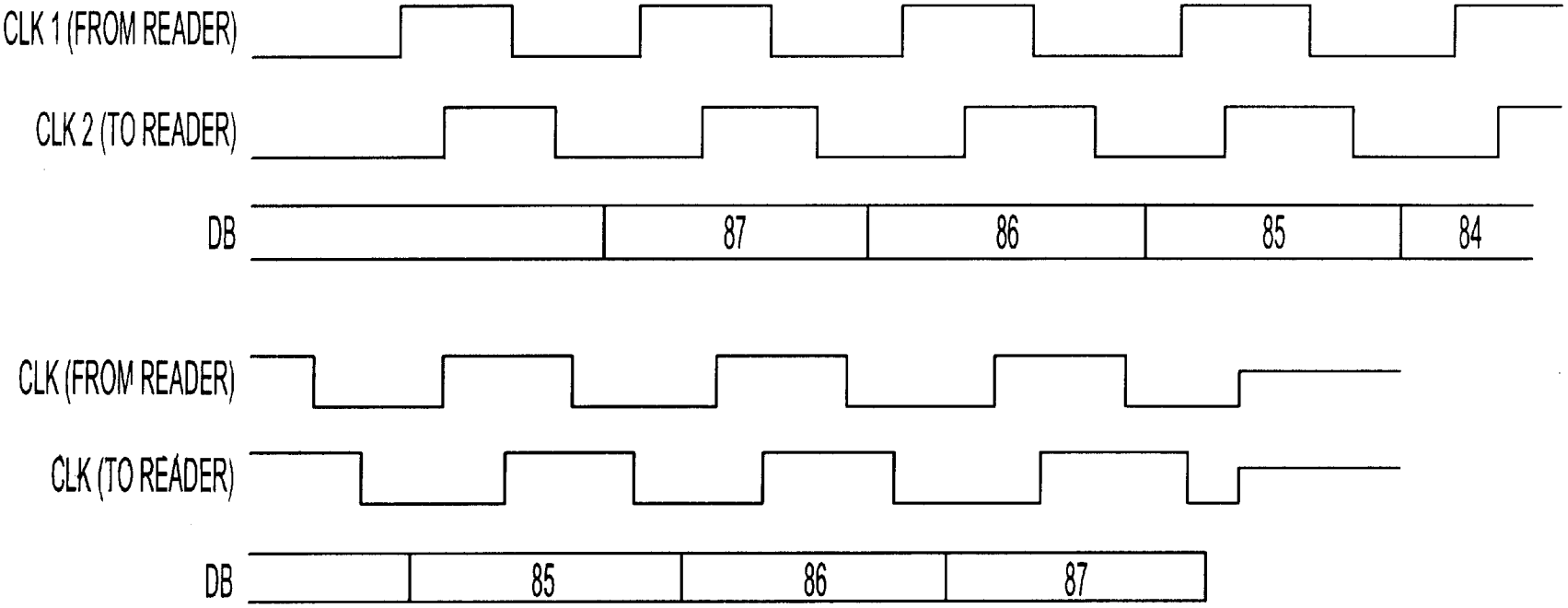
FIG. 13 shows the communication timing between a monitoring system and a reading device, such as during processing of the steps of the flow chart of FIG. 9 or a subroutine thereof.

The transmission of information between the reader and the log may be better appreciated with reference to FIG. 13. As shown, both the reader and the log include a clock. Although the transmitting and receiving steps are described in terms of turning the clock from a normally low state to a high state, it will be appreciated that the reverse setting may be used instead. Transmitting clock CLK1 of the device transmitting information goes high to indicate that information is to be transmitted. Upon receipt of such signal by the device receiving information, the clock CLK2 of the device receiving information goes high as well. Transmitting clock CLK1 remains high until it has received a signal that receiving clock CLK2 is high (and thus ready to receive information from the sending device) and then returns to its initial, low condition. Information is then transmitted, in preferably discrete units such as bytes, along databus DB. These steps are repeated until the entire signal to be transmitted has been sent and received.: As noted above, connections 398 for transmission of such data are provided in the circuitry of the log.

If information has been transmitted to the log from the reader, then the log performs the process packet subroutine of FIG. 14. It will be appreciated that according to the subroutine of FIG. 14, preferably only one command is read and followed during each pass through the main program of FIG. 9. The first step of the process packet subroutine is to get a packet command received from the reader (such as by reading a buffer) at step 462. For example, the first byte of data stored in a packet buffer may be a command indicating what type of task is to be performed by the packet. The log then proceeds to determine the nature of the command (e.g., the first data byte) by testing if the command is one of several types of commands which may be transmitted thereto by the reader. Thus, query 464 tests whether the command is a first type of command. If yes, then the log performs the step required by such command. In the exemplary flowchart of FIG. 14, the first type of command is a time set command. Thus, at step 466 the log gets the time from the packet buffer and writes such information to the real time clock to set the proper time. After performing step 466, the subroutine then returns to the main program of FIG. 9.

If the command is not the first type of command, then the subroutine tests, at query 468, whether the command is a second type of command. If yes, then the log performs the step required by such command. In FIG. 14, the second type of command is a date set command. Thus, at step 470 the log gets the date from the packet buffer and writes such information to the clock to set the proper date. After performing step 470, the subroutine then returns to the main program of FIG. 9.

If the command is not the second type of command, the subroutine tests, at query 472, if the command is a third type of command. If yes, then the log performs the step required by such command. In FIG. 3, the third type of command is an information request. Thus, at step 474 the log gets an event from the programmable memory in which events are stored during functioning of the log as described above, and transmits the information to the reader. After performing step 474, the subroutine returns to the main program of FIG. 9. If the command is not the third type of command, similar tests and steps may be performed if additional types of commands: may be transmitted to the log.

It will be appreciated that the nature of the command may be determined in any desired order other than by the above-described sequence of queries, the next in the list of command types being tested if the command is riot identified. If the subroutine passes through all tests for command type without branching to another step in response to identification of the command, then step 476 identifies the command as illegal, tells the log to ignore the command, and returns the subroutine to the main program of FIG. 9.

Thus, in accordance with the principles of the present invention, the log keeps a record of information gathered by the monitoring system of the present invention, such as the frequency of monitored event occurrences and the time elapsed between such occurrences and the giving of care or attendance to such event by the care giver. Various modifications and additional data-processing programs and devices may be used to process the recorded information, as will be appreciated by those of ordinary skill in the art.

While the foregoing description and drawings represent the preferred embodiments of the present invention, it will be understood that various additions, modifications and substitutions may be made therein without departing from the spirit and scope of the present invention as defined in the accompanying claims. For example, the particular components of the exemplary block diagrams (such as the value of the resistors, etc.) may be modified as desired and as necessary. Moreover, the steps in the exemplary flow charts may be modified, various other implementations being within the scope of the invention. It will be clear to those skilled in the art that the present invention may be embodied in other forms, structures, arrangements, proportions, and with other elements, materials, and components, without departing from the spirit or essential characteristics thereof. For example, it will be appreciated that the condition detected by a monitoring system formed in accordance with the principles oaf the present need not be wetness, but instead may be any other type of condition capable of being sensed by a sensor device. Moreover, the type of care to be given is not necessarily the turning of the patient, but any other type of care which must be performed on a regular or at least semi-regular basis, such as feeding, medicating, etc. The presently disclosed embodiments are therefore to be considered in all respects as illustrative and not restrictive, the scope of the invention being indicated by the appended claims, and not limited to the foregoing description.

What is claimed is:

1. A personal care monitoring system comprising:

a wetness detecting sensor;

a turn alert timer set to monitor turn alert time elapsed after care has been given;

a wetness indicator in communication with said wetness detecting sensor;

a turn alert indicator in communication with said turn alert timer and configured to indicate when said turn alert time has elapsed; and a processor programmed to control said turn alert timer, said wetness indicator, and said turn alert indicator.

2. A monitoring system as in claim 1, wherein said processing means is programmed to place said monitoring system into a temporary sleep mode after checking if said wetness detecting sensor has detected wetness or if said turn alert time has elapsed.

3. A monitoring system as in claim 1, further including a reset button configured to reset said turn alert timer.

4. A monitoring system as in claim 3, wherein said reset button is configured:

to generate an on/off state change signal to change the on/off state of said turn alert timer after being depressed for a predetermined period of on/off time; and to generate a reset signal to reset said turn alert timer upon being depressed for an amount of time less than said on/off time.

5. A monitoring system as in claim 4, wherein said processing means monitors the duration said reset button is pressed to determine whether an on/off signal or a reset signal should be generated.

6. A monitoring system as in claim 1, wherein said processor checks through each program run whether said wetness detecting sensor has sensed wetness in order to turn on said wetness indicator.

7. A monitoring system as in claim 1, wherein said wetness indicator is a visual indicator.

8. A monitoring system as in claim 7, wherein said wetness indicator is an LED.

9. A monitoring system as in claim 1, wherein said wetness indicator is a vibrating device indicator.

10. A monitoring system as in claim 1, further comprising a transmitter configured to emit a signal from one or both of said indicators to a remote location.

11. A monitoring system as in claim 1, wherein said processor includes memory for storing data related to the functioning of at least one of said wetness detecting sensor, said turn alert timer, said wetness indicator, and said turn alert indicator.

12. A monitoring system as in claim 1, further including a reset button configured, upon depression thereof, to generate one of an on/off state change signal or a reset signal after being depressed for longer than a predetermined period of time and to generate the other of said on/off state change signal or said reset signal after being released before said predetermined period of time has elapsed.

13. A personal care monitoring system comprising:

a wetness detecting sensor;

a wetness indicator electrically coupled to said wetness detecting sensor; and a processing means programmed to control said wetness indicator and to record data relating to both the time at which wetness is detected and the time at which wetness is no longer detected such that the time elapsed between the occurrence of wetness and the attendance to such wetness may be calculated wherein said processing means is programmed to place said processing means in a sleep mode for a predetermined period of time, and to awaken said processing means periodically from said sleep mode after said predetermined period of time to check if said wetness detecting sensor has detected wetness.

14. A monitoring system as in claim 13, further comprising a transmitting device configured to transmit data from said processing means to a receiving device configured to receive and analyze said data.

15. A monitoring system as in claim 13, wherein said processing means is programmed to return said processing means to said sleep mode when wetness is not detected and to continue to awaken said processing means from said sleep mode after said predetermined period of time to continue to check periodically if said wetness detecting sensor has detected wetness, whereby said sleep mode reduces power used by said monitoring system.

16. A personal care monitoring system comprising:

a turn alert timer set to monitor turn alert time elapsed after care has been given;

a turn alert indicator configured to indicate when said turn alert time has elapsed;

a processor programmed to control said turn alert timer and said turn alert indicator and to record data relating to the time at which said turn alert time elapses; and a reset button configured, upon depression thereof, to generate one of an on/off state change signal or a reset signal after begin de pressed for greater than a predetermined period of time and to generate the other of said on/off state change signal or said reset signal after being released before said predetermined period of time has elapsed.

17. A monitoring system as in claim 16, further comprising a transmitting device configured to transmit data from said processing means to a receiving device configured to receive and analyze said data.

18. A monitoring system as in claim 16, wherein:

said reset button is configured to change the on/off state of said turn alert time after being pressed for greater than a predetermined amount of time;

said processing means monitors the amount of time said reset button is pressed; and said processing means resets said turn alert timer after said reset button is released before said predetermined amount of time has elapsed.

19. A monitoring system as in claim 18, wherein said processing means is programmed to record data relating to the time at which said turn alert timer is reset such that the time elapsed between the elapse of the turn time and resetting of the turn alert timer may be calculated.

20. A personal care monitoring system comprising:

a condition monitoring sensor;

a condition indicator in communication with said condition monitoring sensor and configured to indicate when the condition monitored by said condition monitoring sensor has been detected;

a processing means programmed to record data relating to the operation of said condition monitoring sensor and said condition indicator; and first and second data transmitting and receiving devices; wherein:

said first data transmitting and receiving device is configured to transmit data from said processing means and to receive data from said second data transmitting and receiving device; and said second data transmitting and receiving device is configured to receive data from said processing means via said first data transmitting and receiving device and to transmit data to said processing means via said first data transmitting and receiving device.

21. A personal care monitoring system as in claim 20, wherein said processing means controls transmission of data between said first and second data transmitting and receiving devices.

22. A personal care monitoring system as in claim 20, wherein said processing means records the time at which a condition monitored by said condition monitoring sensor is detected and the time at which said condition is no longer detected.

23. A personal care monitoring system as in claim 20, wherein:

said condition monitoring sensor includes first and second condition monitoring sensors configured to monitor different conditions; and said condition indicator includes a first condition indicator configured to indicate detection of a condition monitored by said first condition monitoring sensor and a second condition indicator configured to indicate detection of a condition monitored by said second condition monitoring sensor.

24. A personal care monitoring system as in claim 20, further comprising:

a first housing in which said condition monitoring sensor, said condition indicator, and said first data transmitting and receiving device are housed; and a second housing in which said second data transmitting and receiving device are housed.

* * * * *

UNITED STATES PATENT AND TRADEMARK OFFICE

CERTIFICATE OF CORRECTION

PATENT NO. : 6,384,728 B1 
DATED : May 7, 2002
INVENTOR(S) : Steven E. Kanor and Richard C. Hirsch It is certified that error appears in the above-identified patent and that said Letters Patent is hereby corrected as shown below:

Column 24,
Line 11, thereof, "begin de pressed" should be -- being depressed --.

Signed and Sealed this

Ninth Day of July, 2002

*Attest:*

*Attesting Officer*

JAMES E. ROGAN
*Director of the United States Patent and Trademark Office*